US010676958B2

(12) United States Patent
Short et al.

(10) Patent No.: US 10,676,958 B2
(45) Date of Patent: Jun. 9, 2020

(54) GATE POST FOR FENCING SYSTEM

(71) Applicant: Master-Halco, Inc., Dallas, TX (US)

(72) Inventors: Jerry L. Short, Washougal, WA (US); Timothy O'Brien, Belvidere, NJ (US); Gary Saletrik, Flower Mound, TX (US)

(73) Assignee: Master-Halco, Inc., Dallas, TX (US)

( * ) Notice: Subject to any disclaimer, the term of this patent is extended or adjusted under 35 U.S.C. 154(b) by 0 days.

(21) Appl. No.: 16/459,458

(22) Filed: Jul. 1, 2019

(65) Prior Publication Data

US 2019/0323260 A1 Oct. 24, 2019

Related U.S. Application Data

(63) Continuation-in-part of application No. 15/909,346, filed on Mar. 1, 2018, which is a continuation of application No. 15/687,372, filed on Aug. 25, 2017, now Pat. No. 9,909,337.

(51) Int. Cl.

| | |
|---|---|
| ***E04H 17/00*** | (2006.01) |
| ***E04H 17/20*** | (2006.01) |
| ***E04H 17/14*** | (2006.01) |

(52) U.S. Cl.

CPC ..... *E04H 17/20* (2013.01); *E04H 17/1421* (2013.01); *E04H 17/1434* (2013.01); *E04H 2017/1452* (2013.01)

(58) Field of Classification Search

CPC ..... E04H 17/1417; E04H 17/1421; E04H 17/1434; E04H 17/1439; E04H 17/20; E04H 2017/1447; E04H 2017/1452; E04H 2017/146

USPC ..... 248/218.4, 219.1, 224.8; 256/65.02, 256/DIG. 5

See application file for complete search history.

(56) References Cited

U.S. PATENT DOCUMENTS

| | | | | |
|---|---|---|---|---|
| 1,867,816 | A | 7/1932 | Finkbeiner | |
| 3,942,763 | A * | 3/1976 | Helterbrand | E04F 11/1817 256/22 |
| 5,277,408 | A | 1/1994 | Parker | |
| 5,452,880 | A * | 9/1995 | Bailey | E04F 11/1834 256/24 |
| 5,494,261 | A * | 2/1996 | Gandara | E04H 17/166 256/24 |
| 5,628,495 | A * | 5/1997 | Gandara | E04H 17/165 256/24 |
| 5,788,224 | A | 8/1998 | Platt | |
| 6,061,991 | A * | 5/2000 | Dahl | E01D 19/103 52/832 |
| 6,173,945 | B1 | 1/2001 | Lindsey | |
| 7,125,002 | B2 | 10/2006 | Platt | |

(Continued)

FOREIGN PATENT DOCUMENTS

WO WO 2014/040091 3/2014

*Primary Examiner* — Matthew R McMahon

(74) *Attorney, Agent, or Firm* — Knobbe, Martens, Olson & Bear, LLP

(57) ABSTRACT

An improved fencing system can include improved fence posts. Such fence posts can include features for accommodating different types of fasteners for attachment to fence components, such as fence rails. Additionally, some fence posts, such as gateposts, can be formed with one or more pieces of other fenceposts in a fencing system. Some such improved fence posts can include concrete locks.

16 Claims, 17 Drawing Sheets

(56) References Cited

U.S. PATENT DOCUMENTS

| | | | | |
|---|---|---|---|---|
| 7,147,213 | B1 * | 12/2006 | Amendola | E06B 11/02 256/73 |
| 7,571,897 | B2 | 8/2009 | Heinz | |
| 8,028,974 | B2 * | 10/2011 | Mann | E04H 17/20 256/21 |
| 8,382,070 | B1 * | 2/2013 | Gibbs | E04H 17/1434 256/65.02 |
| 8,955,250 | B2 | 2/2015 | Johnson | |
| 9,115,506 | B2 | 8/2015 | Hill | |
| 9,518,404 | B2 | 12/2016 | Volin | |
| 9,909,337 | B1 | 3/2018 | Moreno et al. | |
| 2006/0175594 | A1 | 8/2006 | Burkart | |
| 2008/0296547 | A1 | 12/2008 | Renteria | |
| 2010/0001247 | A1 * | 1/2010 | Jaimes | E04H 17/168 256/65.01 |
| 2010/0108969 | A1 | 5/2010 | Platt | |
| 2013/0207062 | A1 * | 8/2013 | Guthrie | E04H 17/1421 256/65.02 |
| 2014/0264220 | A1 | 9/2014 | Doyle | |
| 2015/0248851 | A1 | 9/2015 | Stoddard | |
| 2016/0145893 | A1 | 5/2016 | Coulston | |

* cited by examiner

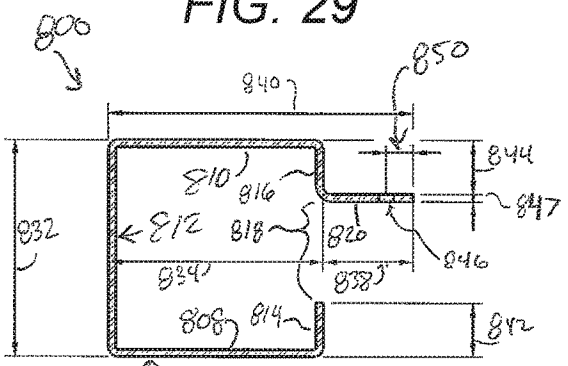
FIG. 29
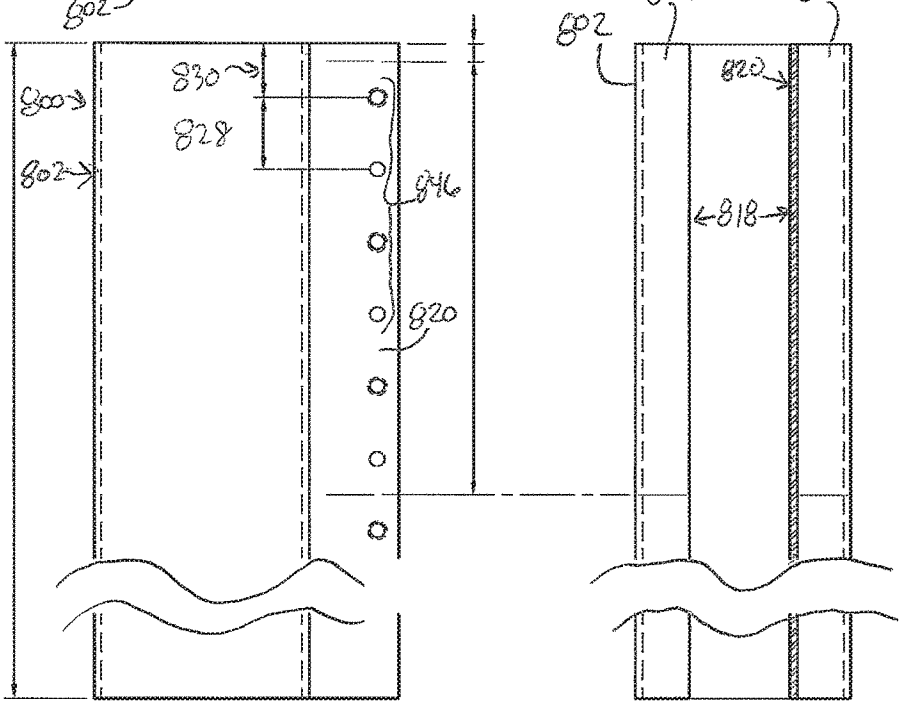
FIG. 30
FIG. 31
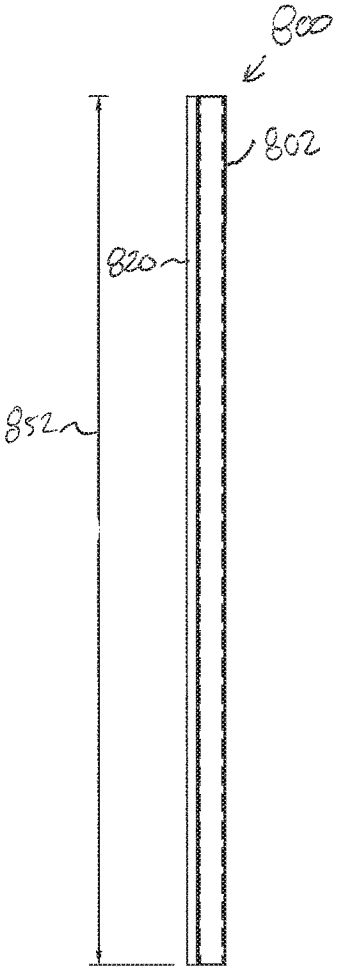
FIG. 28

GATE POST FOR FENCING SYSTEM

BACKGROUND

Field of the Inventions

The present inventions generally relate to fencing systems, and in particular, fencing systems which include improved fence posts, gateposts and posts with concrete locks which can be used in conjunction with fencing systems.

Description of the Related Art

Traditionally, wooden fence posts have been used to construct wooden fences. Wooden fences are desirable because of the appearance of the fence, especially for residential homes.

It is also known to use galvanized steel post components having various different cross-sectional configurations. Some designs, such as those disclosed in U.S. Pat. No. 6,173,945, include wooden fencing systems with steel posts having a channel-shaped configuration and which can be directly attached to wooden fence rails and other wooden components.

SUMMARY

An aspect of at least one of the inventions disclosed herein includes the realization that a gate post can be formed from an elongated member having a generally U-shaped cross-section and an additional mounting flange portion extending generally parallel to the side walls U-shaped cross-section. Such a structural configuration can provide a more rigid or stiffer structural member for better securing the free ends of a fence rails adjacent to a gate as well as mounting of a gate with hinges.

Another aspect of at least one of the inventions disclosed herein includes the realization that forming a gate post having a generally U-shaped cross-section with side walls that are spaced apart at a distance greater than the thickness of a fence rail can provide a gate post that can be quickly and easily connected to a fence rail while at the same time providing enhanced stiffness due to the cross-section being wider than the fence rail. For example, in some specific embodiments, a gate post can have a generally U-shaped cross-section with two side walls spaced apart by a distance at least about 1½"; the normal thickness of a standard 2×4 fence rail. In some modes of use, this can allow the fence rail to be inserted into the space between the two side walls which can provide for a more secure attachment between the gate post and the fence rail. This can reduce the likelihood of the fence rail to be split by the drilling of fasteners through the fence rail.

Further, in some embodiments, the above-noted gate post can have an overall width that is at least as large as the thickness of a fence rail and the thickness of a fence board. As such, the fence post can provide a final assembled state with an outer surface that is substantially flush with an outer surface of the fence board. As such, this configuration can provide a uniform appearance of the fence, when assembled.

Thus, in some embodiments, a gate post can comprise an elongated generally U-shaped channel member having a first side wall, a second side wall extending parallel to the first side wall and being spaced from the first sidewall by a channel width, and a center wall connecting the first and second side walls. The first and second side walls and the center wall forming a U-shaped channel. The elongate generally U-shaped channel member can have a lower end and an upper end, the lower end configured to be inserted into the ground. A first end wall can extend inwardly from the first side wall, toward the second side wall, the first end wall having an first inner edge disposed inwardly from the first sidewall. The gate post can also include a first flange having a first inner edge connected to the first side wall by the first end wall and having a first outer edge, the first flange extending transverse to the first end wall.

Another aspect of at least one of the inventions disclosed herein includes the realization that fence posts can more readily accommodate diverse types of fasteners and installation options if they are pre-drilled with different types of fastener apertures. For example, where a fence post is provided with alternating patterns of different types of fastener apertures, an installer of a fence can arbitrarily, at the time of construction, choose between a plurality of different fasteners for building the fence. Further, an installer may choose to use one type of fastener in one portion of a fence, and a different fastener in a different area of the fence. However, with such an accommodating fence post having alternating patterns of different types of openings, an installer can benefit from the dual advantages of utilizing the same fence post at various locations and different fasteners at different locations along the fence.

Thus, in accordance with some embodiments, a fencepost for can comprise an elongated fencepost member having a lower end and an upper end, the lower end configured to be inserted into the ground. A flange can be connected to the elongated fencepost member. The flange can include a plurality of openings arranged longitudinally along the flange, the openings including at least two straight openings and at least two countersunk openings arranged in an alternating pattern.

Another aspect of at least one of the inventions disclosed herein include the realization that a fencepost can be provided with parallel columns of patterned holes, having an offset arrangement of alternating straight and countersunk holes so as to provide more flexibility in the alignment of fence rails with the desired type of hole as well as providing further reduction of risk of splitting a wooden fence rail. For example, occasionally, when multiple, screws typically used for fencing (e.g., "wood screws") are driven through a fence rail in a closely-spaced pattern, the fence rail splits. Sometimes this is caused by natural variation in the strength of the wood, sometimes caused by screw placement, e.g., too close to an edge of the rail. Thus, in some embodiments, a fencepost has a plurality of columns of alternating straight or and countersunk holes, that are offset relative to one another. Such an arrangement can provide more options for offsetting a vertical alignment of either countersunk or straight or type fasteners and thereby reduce a risk of unintentional splitting.

Another aspect of at least some of the inventions disclosed herein includes the realization that a fencing system can be built in a more efficient and cost-effective manner by building disparate components using some common parts. For example, a fencing system typically includes fenceposts used for supporting spans of longitudinally arranged fencing, which are subjected to certain forces. Such fencing systems also typically include gateposts which support a swinging gate, for example, where such gateposts are subjected often to substantially higher loads generated by the swinging gate assembly. Thus, typically, fenceposts and gateposts of a single fencing system are made from different parts. If they were made from the same part, designed to withstand the greater maximum loads of the gate post use, then the other fenceposts would typically be over-engineered and thus more expensive than necessary.

Thus, in some embodiments, a fencing system includes a plurality of fenceposts made from a first post member and at least one gate post formed of one of the first post members and a secondary layer having a complimentary cross-sectional shape to that of the fencepost. As such, a gatepost can be partially constructed from the same parts forming the gateposts, thereby reducing costs and complexity of a fencing system design.

Another aspect of at least one of the inventions disclosed herein includes the realization that concrete typically used for footings for fence posts can include significant amounts of granular materials, such as stones, which can have one or more dimensions of about 1½ inches or more, some of such granular materials having non-uniform and non-round shapes. The inclusion of granular materials of such dimensions can negatively impact the flowability of the concrete when the concrete is poured during construction of a footing. Thus, when used for a fence post footing, the larger granular materials can impede flow of the associated concrete through an aperture in a lower end of a footing.

Thus, in accordance with some embodiments, a fence post can include a concrete lock aperture having at least one dimension of at least about 2.5 inches and in some embodiments, at least about three-inches. With such a configuration, the concrete lock aperture can better allow larger pieces of granular material included in the concrete during construction of a footing to flow through the concrete lock and prevent the blockage of the concrete lock and thereby prevent the formation of large voids around the concrete lock and provide better anchoring of the associated fence post in the footing.

BRIEF DESCRIPTION OF THE DRAWINGS

FIG. 28 is a front elevational view of another embodiment of a gate post.

FIG. 29 is a top plan view of the gate post in FIG. 28.

FIG. 30 is a back elevational view of the gate post of FIG. 28.

FIG. 31 is a left side elevational view of the gate post of FIG. 28.

DETAILED DESCRIPTION

The present inventions are disclosed in the context of improved metal posts for use with wooden fencing systems because they have particular utility in this context. However, the inventions disclosed herein can be used in other contexts. Thus, the principles of the present inventions are not limited to metal fenceposts used with wooden fences. It is understood, in light of the present disclosure, that the fenceposts disclosed herein can be successfully used in connection with other types of fences, walls, and barriers.

Additionally, to assist in the description of the embodiments of fenceposts and fencing systems disclosed herein, words such as upward, downward, vertical, and horizontal are used to describe the accompanying figures. However, the present inventions can be located in a variety of desired positions, including various angles, sideways, and even upside down. A detailed description of the fencing system is set forth below.

Figure 1:
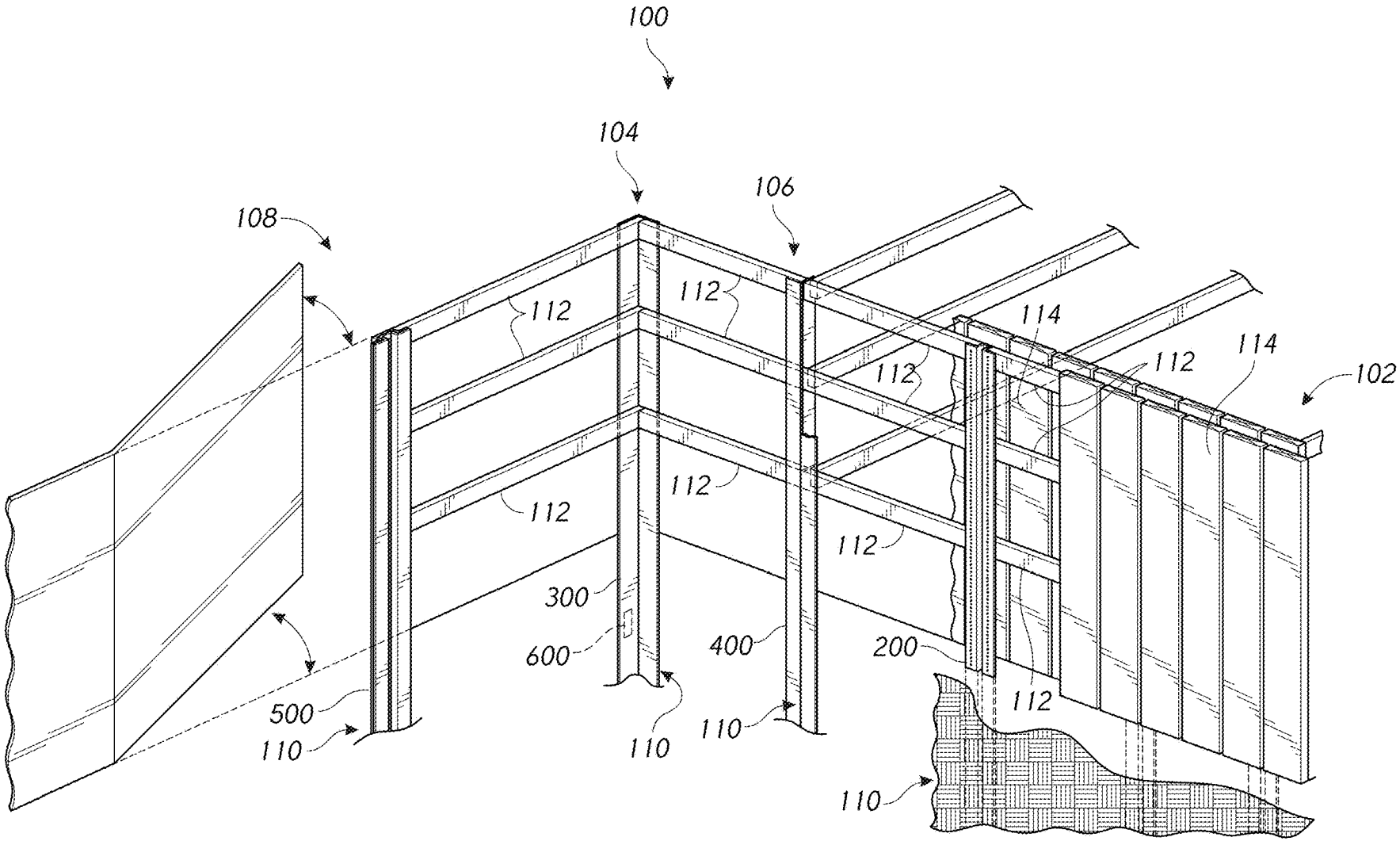
FIG. 1 is perspective view of a fencing system in accordance with an embodiment, including straight fencing sections, corner fencing sections, a T section, and a gate assembly.

With reference to FIG. 1, an embodiment of a fencing system 100 can include various different sections of fencing. For example, the fencing system 100 can include straight sections 102, corner sections 104, T-sections 106, gate assemblies 108, and/or other flat or curved sections (not shown). The embodiment of the fencing system 100 includes certain components designed for use in the respective sections 102, 104, 106, 108.

In some embodiments, straight sections 102 of the fencing system 100 can be constructed with fenceposts 200. Corner sections 104 can be constructed with corner posts 300. T-joint sections 106 can be constructed with T-posts 400, and gate assemblies 108 can be constructed with one or more gate posts 500. Any one or all of the posts 200, 300, 400, 500 can optionally include one or more concrete locks 600 (only one being illustrated on corner post 300 in FIG. 1).

The various posts 200, 300, 400, 500, with or without optional concrete locks 600, can be used to support various sections of the fencing system 100, such as sections 102, 104, 106, 108, and/or other sections or types of fencing. The fencing system 100 is in the form of a wooden fence having steel posts. In other words, the fencing system 100 appears to be an entirely wooden fence to an observer because the posts 200, 300, 400, 500, as installed in a completed fencing system 100, are almost entirely invisible or substantially invisible to the user.

For example, the fencing system 100 can be constructed by initially installing the posts 200, 300, 400, 500 in various desired locations with concrete footings 110. Other techniques can also be used for securing the posts 200, 300, 400, 500 into the ground. For example, any one or all of the posts 200, 300, 400, 500 can be inserted directly into soil if a user chooses to avoid the cost of concrete footings 110.

With the posts 200, 300, 400, 500 secured into the ground, wood fencing components can be attached thereto. For example, with continued reference to FIG. 1, fence rails 112 can be placed between the posts 200, 300, 400, 500 and secured to flanges thereof (described in greater detail below). With the fence rails 112 in place and secured to the various posts, fence boards 114 can be attached to the fence rails. If desired, fence boards 114 can be secured to both sides of the fence rails 112, thereby forming a double layer of fence boards. In this configuration, having two layers of fence boards 114 would provide an outer appearance with a continuous or substantially continuous wooden fence with no metal components visible or easily seen.

Where a fence section is intended to be covered with fence boards 114 on a side with exposed flanges of the posts 200, 300, 400, 500, of the section, it is advantageous if countersunk fasteners are used beneath the boards 114. For example, as viewed in FIG. 1, fence posts 200 includes two flanges on the side facing the viewer of FIG. 1, and wherein the fence rails 112 are secured on the back side of the flanges, as viewed in FIG. 1. In this configuration, different types of fasteners could be used to secure the flanges to the rails 112.

For example, regular screws could be used to attach the flanges to the rails 112. However, if a fence board 114 is placed over the fencepost 200, the protruding heads of the regular screws may make it difficult for the board 114 to be installed in alignment with adjacent boards 114. Thus, a user may choose to use countersunk screws with countersunk holes in the flanges. As such, the screw heads can be installed so that they do not protrude beyond the outer surface of the flange and thus would not interfere with the installation of boards 114, providing for a better alignment of the fence boards 114. The structure and use of fenceposts is described in greater detail below with reference to FIGS. 2-8.

Figure 2:
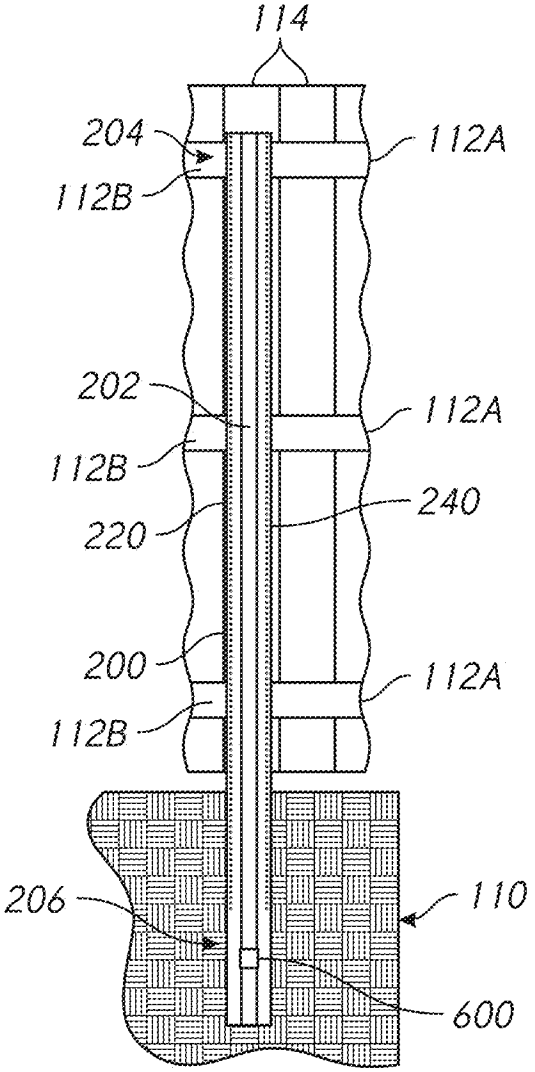
FIG. 2 is a front elevational view of a portion of the fencing system of FIG. 1 illustrating a single fencepost embedded in a concrete footing and supporting a wooden fence structure.

With continued reference to FIGS. 2 and 3, fenceposts 200 includes an elongated fencepost member 202, a first flange 220 and a second flange 240.

The elongated fencepost number 202 can have an upper end 204 and a lower end 206. The lower end can be configured to be inserted into the ground and/or be secured with a concrete footing 110. The upper end 204 can be configured to support fence components, such as components of a wooden fence or fences made from other materials such as those including fence rails 112 and fence boards 114. The post 200 can be used to construct other types of fences as well.

The elongated fence post member 202 can have any cross-sectional shape. In the illustrated embodiment, the elongated fencepost member has a generally U-shaped cross-section. For example, with reference to the top plan view of FIGS. 3A and 3B, the elongated fencepost member 202 can include first sidewall 208, a second sidewall 210, and a center wall 212. The first and second sidewalls 208, 210 extend generally parallel to one another. As used herein, the term "generally parallel" can mean directions that are substantially parallel but not perfectly parallel, for example, they might diverge or converge away from parallel directions by amounts that might result from manufacturing techniques or with otherwise intentional small deviations of about a few degrees.

The center wall 212 connects the sidewalls 208, 210. In some embodiments, the center wall 212 is generally perpendicular to either or both of the sidewalls 208, 210. As used herein, the term "generally perpendicular" includes orientations that are perpendicular or close to perpendicular, including variations that might result from manufacture intolerances or intended deviations from perpendicular within a few degrees.

Together, the first sidewall 208, the second sidewall 210, and the center wall 212 together form a generally U-shaped elongated fencepost member. For example, in some embodiments, the first sidewall 208, the second sidewall 210, and the center wall 212, extend from the upper end 204 to the lower end 206.

Figure 3A:
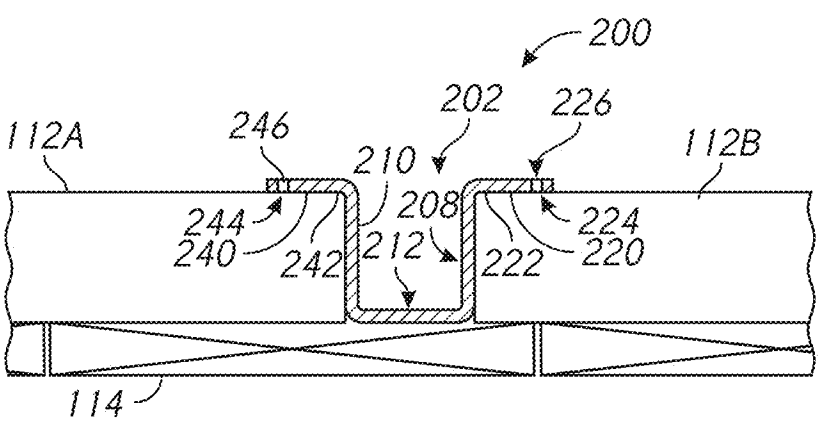
FIG. 3A is a top plan view of the fencing configuration in FIG. 2.
Figure 3B:
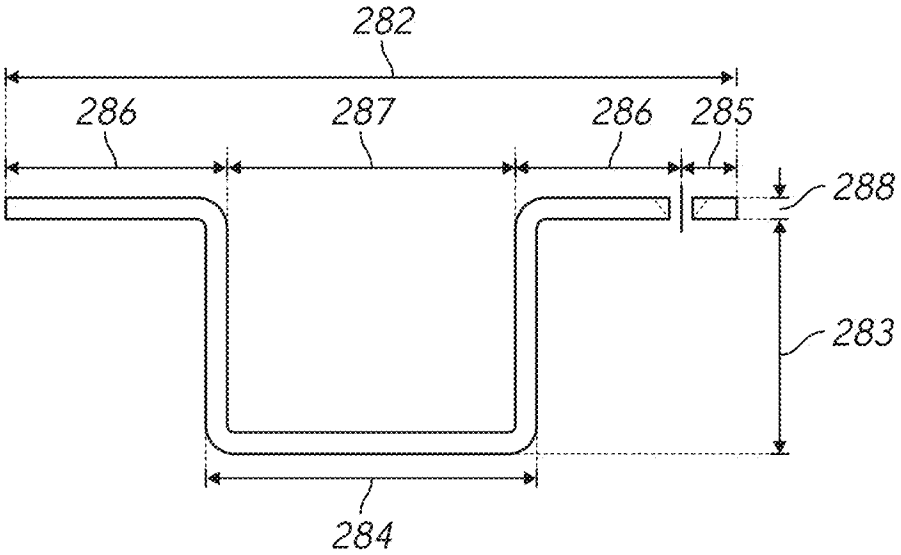
FIG. 3B is an enlarged top plan view of the fencepost of FIG. 2.

With continued reference to FIGS. 3A and 3B, the first flange 220 can include an inner edge 222 and an outer edge 224. The inner edge can be connected to the first sidewall 208. Additionally, the flange 220 can include a plurality of openings 226 configured to receive fasteners for attaching the flange 220 to a fence rail, such as fence rail 112B.

Similarly, the second flange 240 can include an inner edge 242 and an outer edge 244. The inner edge 242 can be connected to the second sidewall 210. The flange 240 can also include a plurality of openings 246 configured to receive fasteners before attaching the flange 240 to a fence rail such as fence rail 112A. The openings 246 can be disposed between the inner edge 242 and the outer edge 244. Similarly, the openings 226 can be disposed between the inner edge 222 and the outer edge 224 of flange 220.

In some embodiments, the elongated fencepost member 202, first flange 220, and second flange 240 can be made from a single monolithic member, for example, from roll formed or stamped steel.

Further, in some embodiments, the post 200 can have an overall width 282 of about 4.5 inches. A hat section of the post can have an outer width 284 of about 2 inches and an inner width 287 of about 1.8 inches. In such embodiments, the thickness 288 can be about 0.1inches, for example, the thickness 288 can be about .12 inches. The post 200 can have a flange width 286 of about 1.3 inches. The plurality of openings 246 can be spaced from the edge of the flange 220 by a spacing 285 of about 0.3 inches. Additionally, the post can have a depth, also referred to a hat depth 283 of about 1.5 inches. Other dimensions can also be used.

Figure 5:
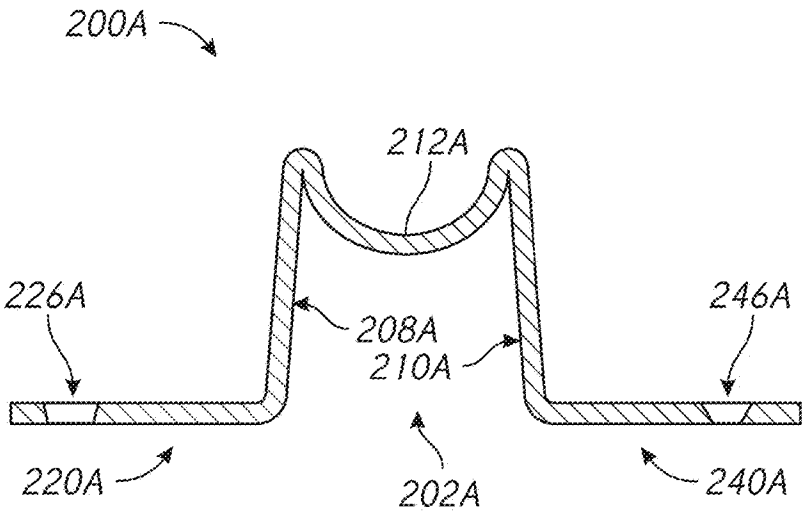
FIG. 5 is a top plan view of the fencepost of FIG. 4.
Figure 4:
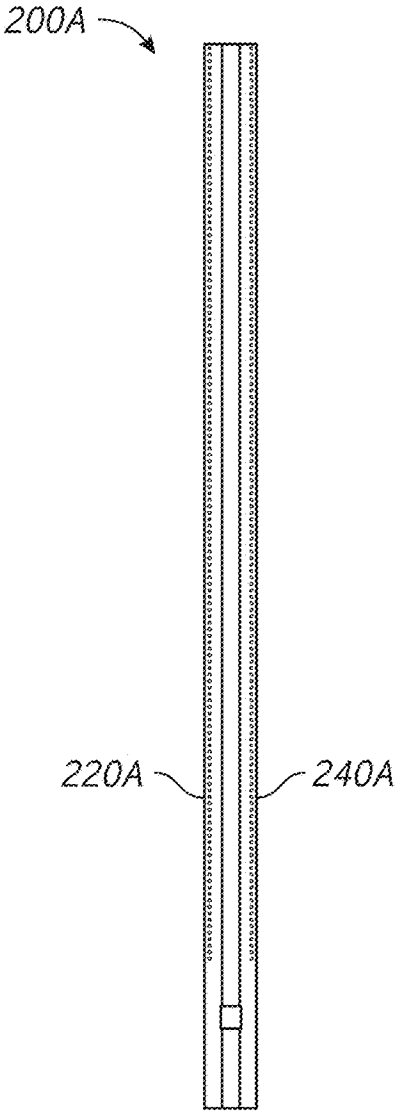
FIG. 4 is a front elevational view of a modification of the fencepost illustrated in FIG. 2.

FIGS. 4 and 5 illustrate a modification of the fencepost 200 identified generally by the reference numeral 200A. Parts, components, features, and advantages of the fencepost 200A that are the same or similar to corresponding parts, features, components, and advantages of fencepost 200 are identified with the same reference numerals used above, except that a letter "A" has been added thereto.

With continued reference to FIGS. 4 and 5, the elongated fencepost member 202A of the post 200A can include generally parallel first and second sidewalls 208A and 210A. The center wall 212A can connect the first and second sidewalls 208A, 210A and extend through an arcuate shape between the sidewalls 208A, 210A.

The arcuate shape of the center wall 212A results in the elongate fencepost member 202A as having a generally U-shaped cross-section. As used herein, the phrase "generally U-shaped cross-section" to include the cross-section illustrated in FIG. 5 in which the first and second sidewalls 208A, 210A are generally but not perfectly parallel and the center wall 212A is arcuate forming a concave shape extending inwardly to interior of the elongated fencepost member 202A.

The arcuate shape of the center wall 212A can provide additional optional benefits. For example, the arcuate shape of the center wall 212A can result in a higher overall stiffness of the post 200A.

Similarly to that described above with reference to FIG. 3, the post 200A can include first and second flanges 220A, 240A, having pluralities of apertures 226A, 246A, respectively.

Figure 6:
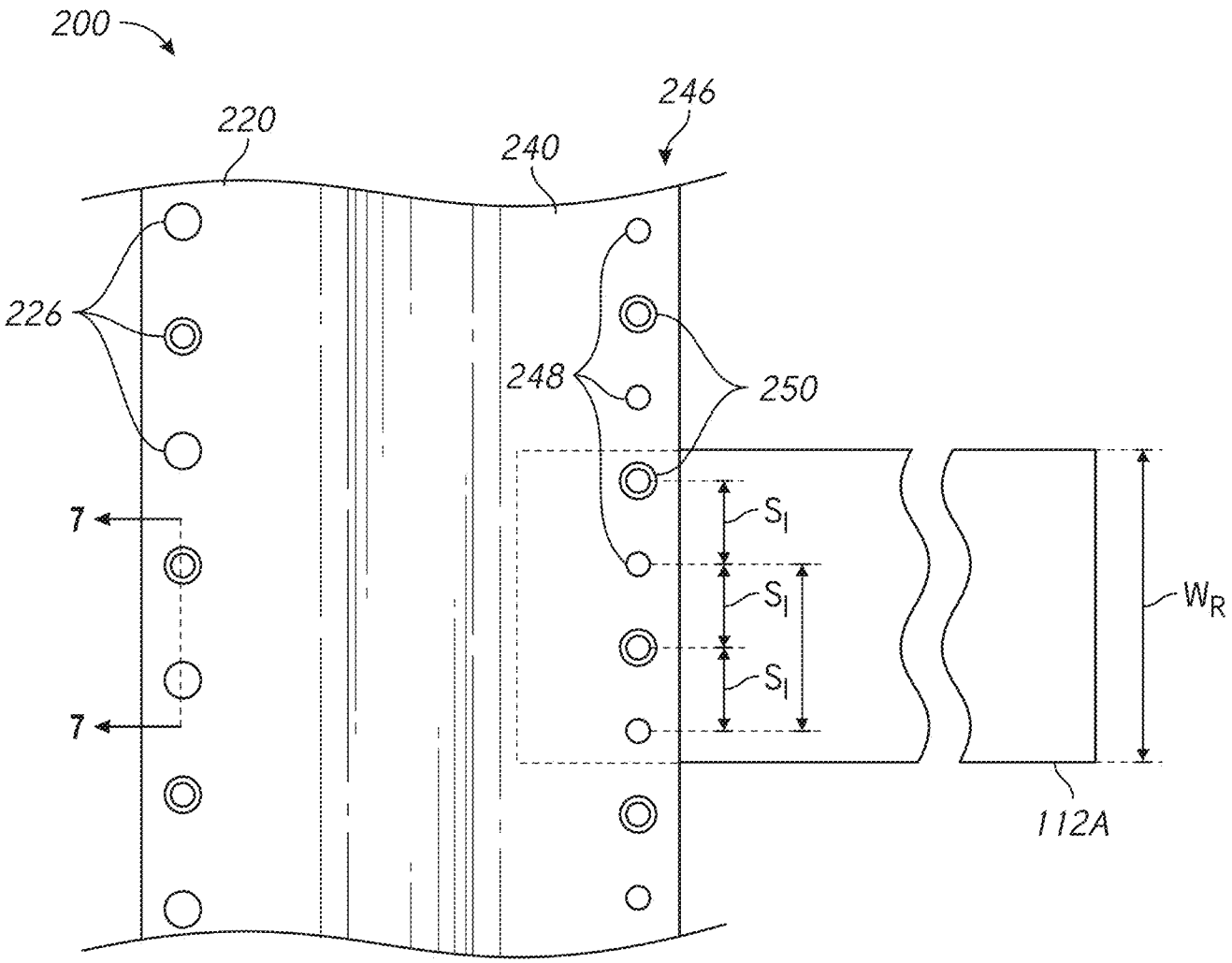
FIG. 6 is an enlarged front elevational view of the fencepost of FIG. 2 illustrating an alternating pattern of pre-drilled openings in the flanges thereof.
Figure 7:
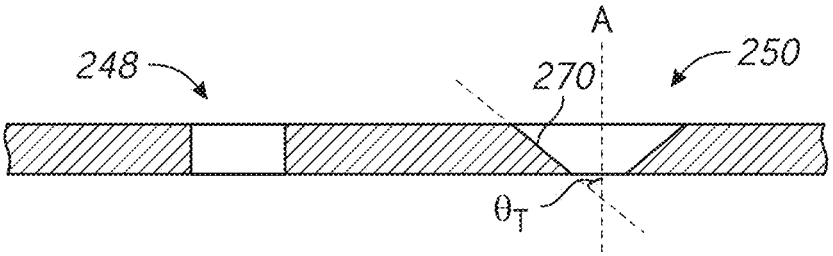
FIG. 7 is a sectional view of straight and countersunk openings included in the fenceposts of FIG. 2, taken along line 7.-7. of FIG. 6.
Figure 8:
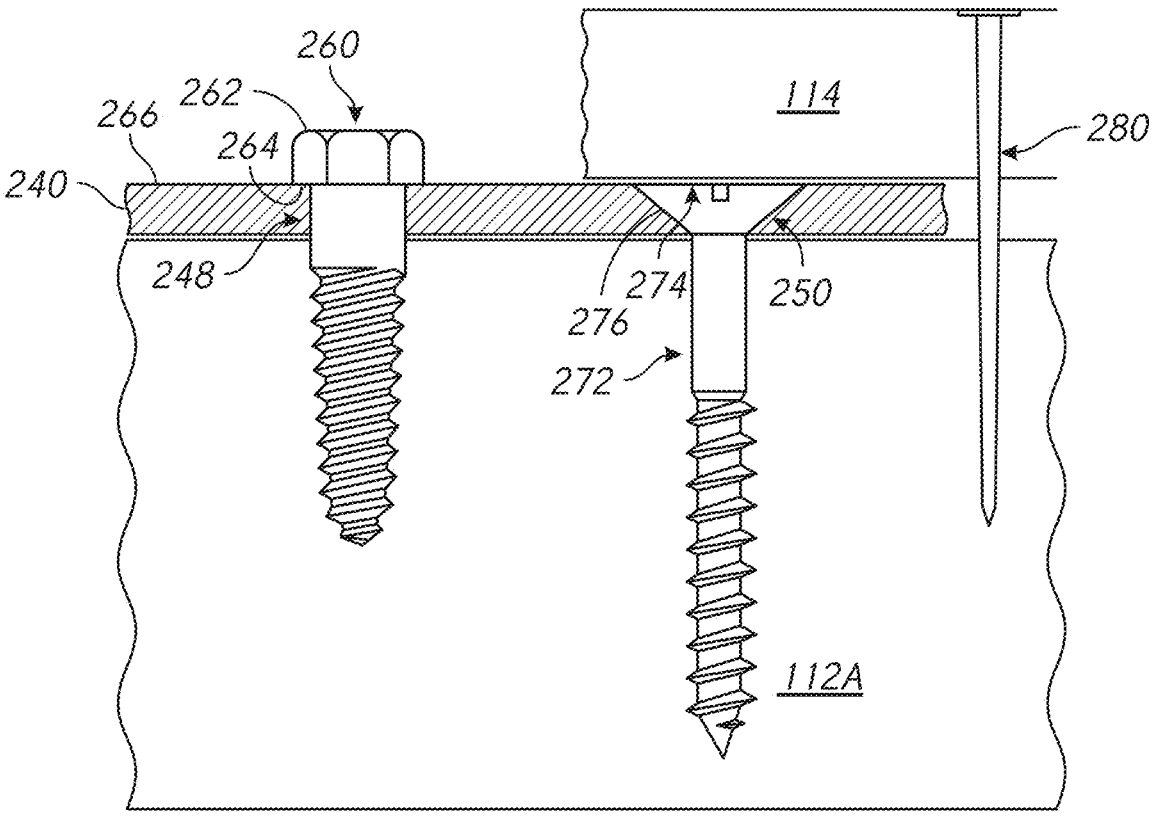
FIG. 8 is an additional view of the enlarged portion of the fencepost including the fasteners extending through the straight and countersunk openings, with a fence rail and a fence board attached thereto.

FIGS. 6-8 includes enlarged sectional and cutaway views of the post 200 with details regarding the plurality of apertures 226, 246. The descriptions of the embodiments illustrated in FIGS. 6-8 also apply equally to the embodiments of FIGS. 4 and 5 as well as any other fenceposts, corner posts, T-post, or gatepost described in the present disclosure. However, only fencepost 200 will be referenced with regard to the description of FIGS. 6-8.

With continued reference to FIGS. 6-8, as described above, the first and second flanges 220, 240 of the fencepost 200 can include pluralities of openings 226, 246, respectively. In some embodiments, one or both of the pluralities of openings 226, 246 can include an alternating pattern of straight openings and countersunk openings. For example, the plurality of openings 246 can include a plurality of straight openings 248 and a plurality of countersunk openings 250. As shown in FIG. 6, the alternating pattern can be defined by a series of openings including one straight opening 248 followed by one countersunk opening 250, followed by another straight opening 248, followed by another countersunk opening 250, for example, in direction from the upper end 204 of the post toward the lower end 206 of the post 200.

The spacing of the straight and countersunk openings 248-250 can be sufficiently close so as to provide optional benefits and/or efficiencies in constructing a fence, such as the fencing system 100. For example, with continued reference to FIG. 6, a fence rail 112A is illustrated as being aligned with a portion of the flange 240. In some embodiments, the plurality of openings 246 are spaced sufficiently close such that at least two straight openings 248 or at least two countersunk openings 250 align with portions of the rail 112A. For example, the rail 112A can have a width $W_R$ that is equal to the standard width dimension of a 2×4 which can be approximately between 3½ inches and four inches (for a "true dimension" 2×4). Thus, in some embodiments, the interhole spacing $S_I$ is about one inch or less. As used herein, the interhole spacing $S_I$ illustrated in FIG. 6 is a center-to-center measurement of adjacent holes, e.g., the distance between a center of a straight opening 248 to a center of a countersunk opening 250. Other measurement techniques can also be used. With such a spacing $S_I$, at least two straight openings 248 or two countersunk openings 250 would fit within the width $W_R$.

Further, additional benefits can also be achieved where the spacing $S_I$ is sufficient to allow at least two straight opening 248 and at least two countersunk openings 250 to lie within a span of the width $W_R$. As such, for any one position in which the rail 112A might be positioned, there are both two straight openings 248 and two countersunk openings 250 that are aligned with a portion of the rail 112A.

Thus, for example, an installer might choose a position of the rail 112A such as that illustrated in FIG. 6, and then can choose whether to use tapered fasteners or regular fasteners. For example, if an installer intended to cover the flanges 220, 240 with fence boards, she may choose to use tapered fasteners in cooperation with the countersunk openings 250. Or, if the installer so chose, he could use regular fasteners inserted through the straight openings 248.

With continued reference to FIGS. 7 and 8, the straight openings 248 can be in the form of holes typically known and referred to as "straight holes" used in the industry. The holes can be drilled with straight-sided drill bits or punched with straight-sided punching devices. These holes 248 are designed and intended to be used with regular screws or lag bolts 260 which have an enlarged head 262 and a flat bottom surface 264. The flat bottom surface 264 properly contacts an outwardly-facing surface 266 of the flange 240. Optionally, a washer (not shown) can be placed between surface 264 and the outward surface 266.

By contrast, the countersunk openings 250 can include slanted sidewall surfaces 270. The slanted sidewall surface 270 can be conical in shape, as is typical for such countersunk openings which are well known in the art. The slanted sidewalls 270 can form an angle $\theta_T$ relative to an axial direction A of the opening 250. The angle $\theta_T$ can be any angle usable for countersunk holes purposes. In some embodiments, the angle $\theta_T$ is between 30 and 60 degrees, and in some embodiments about 40°. Other angles can also be used.

With the configuration of a countersunk hole, the countersunk opening 250 can accept fasteners such as the countersunk fastener 272 which includes a flat upper surface 274 and slanted or conical sidewalls 276 which are slanted in an angle to approximately correspond to the slant of the sidewalls 270. As such, the fastener 272 can be driven through the opening 250 until the sidewalls 276 of the fastener 272 contact the sidewalls 270 of the countersunk opening 250. As such, the upper surface 274 of the fastener 272 can be flush or substantially flush with the upper surface 266 of the flange 240. As such, a fence board 114 can be positioned over the fastener 272 and attached directly to a fence rail 112A, for example, with a nail 280, or any other type of fastener, while making contact across a broad portion of the outer surface 266 of the flange 240 and being spaced away from the fence rail 112A by a distance equal to the thickness of the flange 240.

Figure 11:
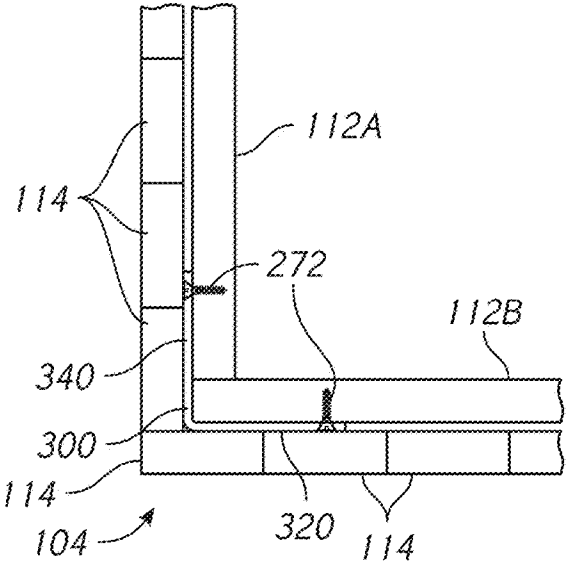
FIG. 11 is a schematic top plan view of an optional use of the fencepost of FIG. 9.
Figure 10:
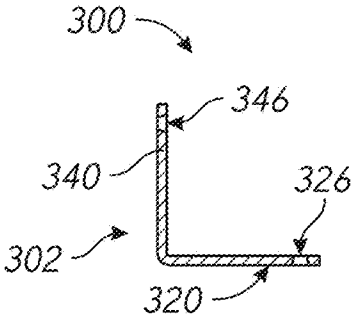
FIG. 10 is a top plan view of the fencepost of FIG. 9.
Figure 9:
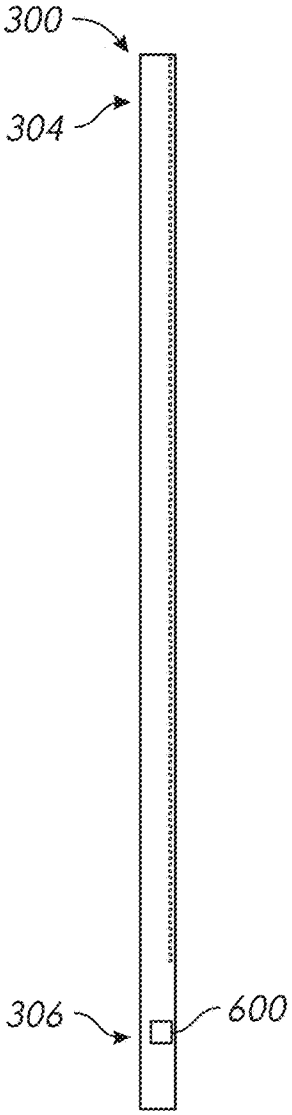
FIG. 9 is a front elevational view of a further modification in the fencepost of FIG. 2.

FIGS. 9-11 illustrate a corner post 300 which, in some embodiments, shares some parts, components, features, and advantages of the post 200 and thus can be considered as a modification of the post 200. Thus, certain parts, components, and features of the post 300 which are similar to the same as corresponding parts, components, and features of the fence post 200, are identified with the same reference numeral used above with regard to fencepost 200, except that "100" can been added to those reference numerals.

With continued reference to FIGS. 9-11, the corner post 300 can include an elongated fencepost member 302. In the illustrated embodiment, the elongated fencepost member 302 is in the form of structural stock material known as "angle iron" or "angle steel."

The corner post 300 can also include first and second flanges, 320, 340 configured for attachment to fencing components such as fence rails 112A, 112B (FIG. 11). The flanges 320. 340 can be formed as separate pieces attached to the elongated fencepost member 302 or formed with the elongated fencepost member 302 in a single monolithic piece.

In some embodiments, the flanges 320, 340 include pluralities of apertures 326, 346, respectively. The pluralities of apertures 326, 346 can include alternating patterns of straight openings and countersunk openings, as described above with reference to the pluralities of openings 226, 246.

With reference to FIG. 11, a fencing system 100 including a corner section 104 can be constructed with a corner post 300 as reflected by the top plan view of FIG. 11. For example, fence rails 112A, 112B can be secured to flanges 340, 320, respectively, by way of fasteners engaged with the pluralities of openings 346, 326, respectively. For example, the countersunk screws 272 can be secured to two or more countersunk openings 250 disposed in the flanges 320, 340 and engage the rails 112A, 112B. After such attachment of the flanges 320, 340 to the rails 112B, 112A, respectively, fence boards 114 can be secured over the exposed heads 274 of the fasteners 272. In some embodiments, fence boards 114 can be attached directly to rails 112A, 112B or attached to the corner posts 300 with adhesive. Other techniques can also be used.

Figure 14:
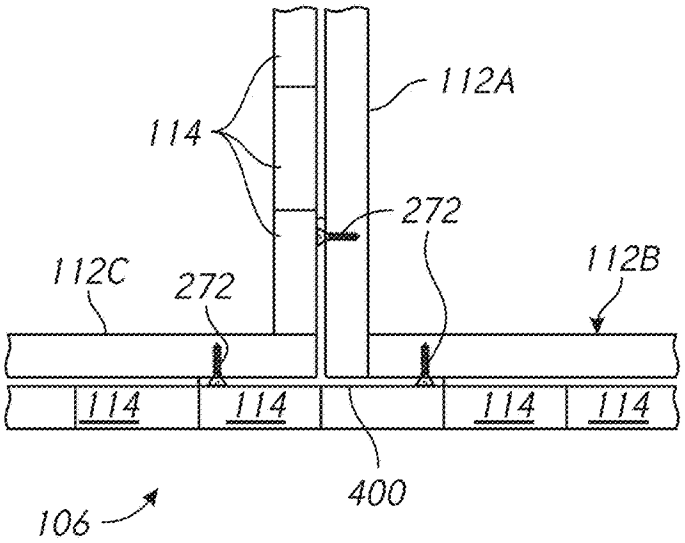
FIG. 14 is a top plan view of an optional use of the fencepost of FIG. 12 incorporated into a fencing section.
Figure 13:
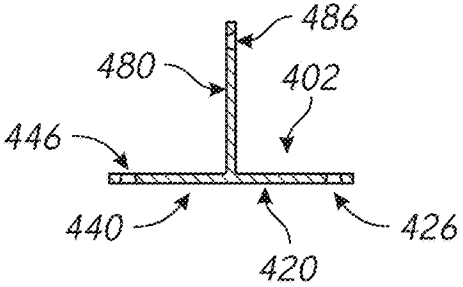
FIG. 13 is a top plan view of the fencepost of FIG. 12.
Figure 12:
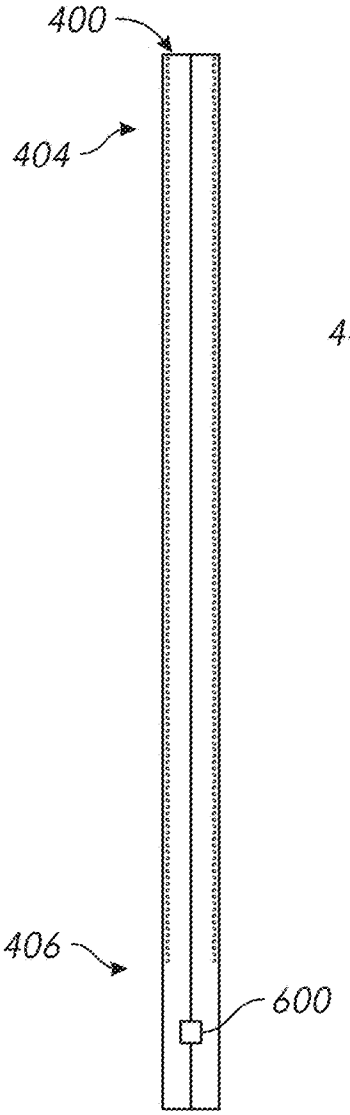
FIG. 12 is a front elevational view of yet another modification of the fencepost of FIG. 2.

FIGS. 12-14 illustrate a T-post 400 which can be used for constructing a T-section 106 (FIG. 1) of a fencing system 100. The T-post 400 can be considered as a modification of the fencepost 200. Thus, parts, components, and features of the T-post 400 that are similar or the same as corresponding parts, components, features of the fencepost 200 are identified using the same reference numerals, except that "200" has been added to the reference numerals of fencepost 200.

With reference to FIG. 13, the T-post 400 can include an elongated fencepost member 402 that has a generally T-shaped cross-section. As such, the elongated fencepost number 402 can be formed from standard stock steel formed with a T-shaped cross-section.

The T-post 400 also includes first flange 420, a second flange 440, and a third flange 480. The flanges 420, 440, 480 can be added to an elongated fencepost number 402 having a T-shaped cross-section, for example by butt welding or the flanges 420, 440, 480 can be considered as modified portions of a single monolithic member with a T-shaped cross-section. Similarly to the posts 200 and 300 above, the flanges 420 and 440 can include pluralities of apertures 426, 446. Additionally, the flange 480 can include a plurality of apertures 486. One, two or all three of the pluralities of openings 426, 446, 486 can comprise alternating patterns of straight and countersunk openings, such as those described above with reference to FIG. 6.

With reference to FIGS. 12 and 14, the T-post 400 can be used for constructing a T-section 106 of a fencing system 100. For example, fence rails 112A, 112B and 112C can be attached to the T-post 400 with fasteners 272 used in conjunction with countersunk openings 250 in the T-post 400. Additionally, fence boards can be attached to the rails 112A, 112B, 112C with other fasteners and/or can be glued to portions of the T-post 400. Other attachment techniques can also be used.

Figure 15:
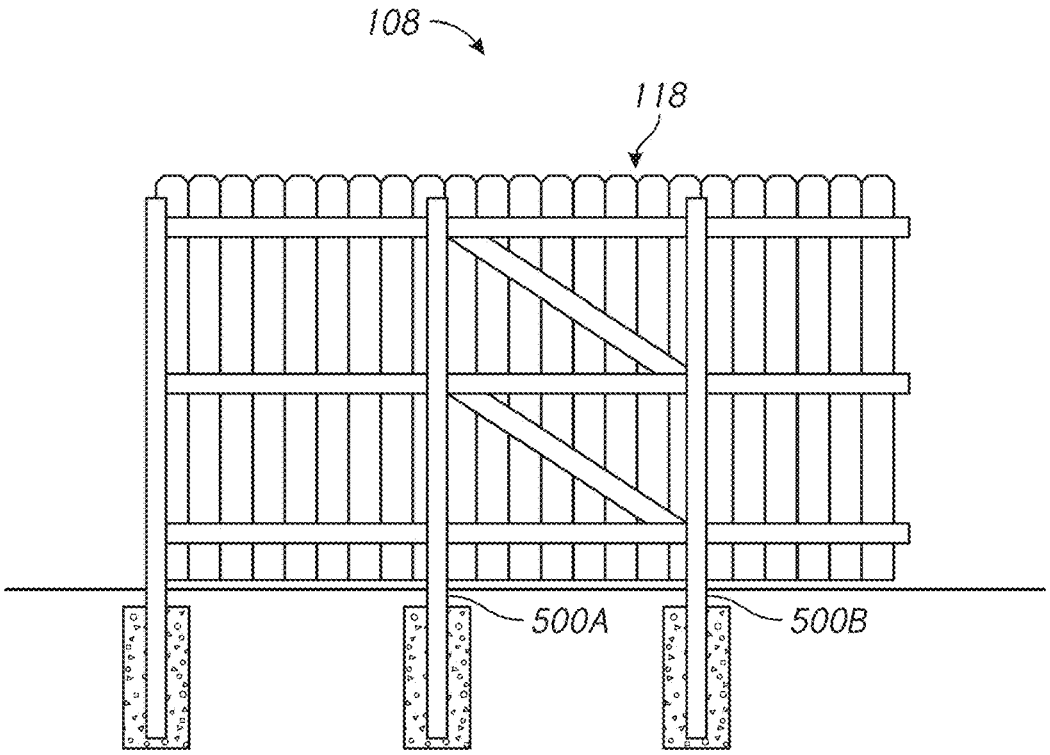
FIG. 15 is a rear elevational view of a gate assembly of the fencing system of FIG. 1.
Figure 16:
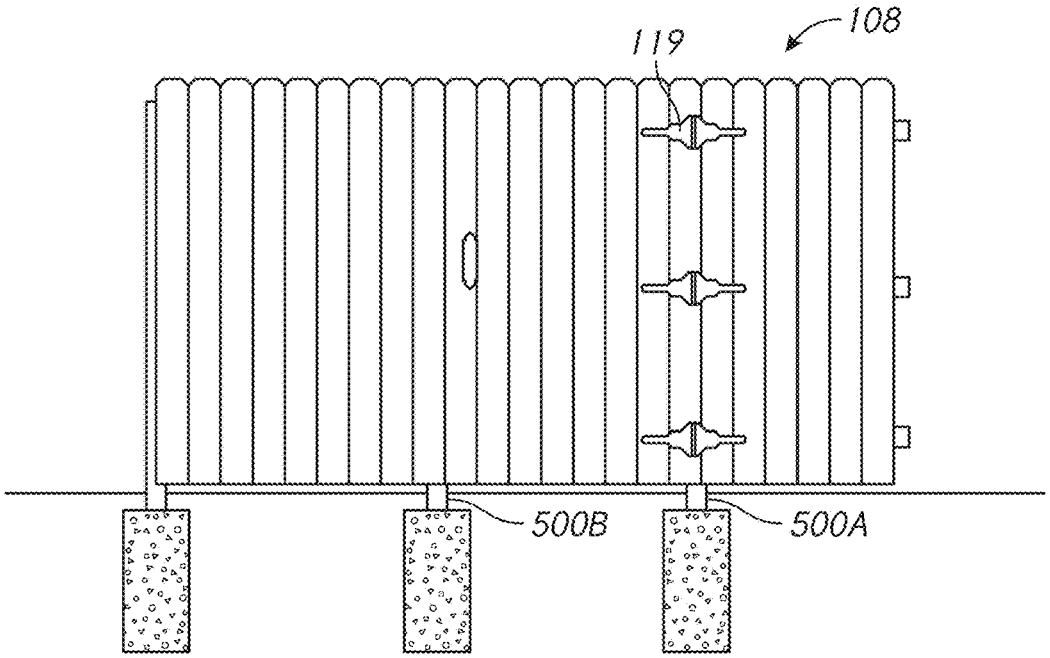
FIG. 16 is a front elevational view of the gate assembly of FIG. 15.
Figure 20:
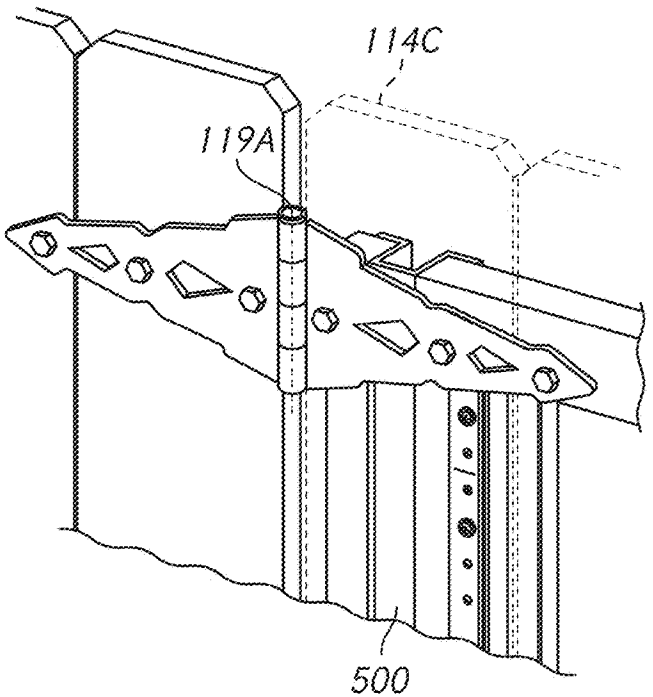
FIG. 20 is an enlarged perspective view of a hinge and gatepost illustrated in FIG. 19.

With reference to FIGS. 15 and 16, a gate section 108 of a fencing system 100 can be constructed with one or more gateposts 500. For example, the gate section 108 can include the first gatepost 500A and optionally, a second gatepost 500B. In the illustrated embodiment, the gate section 108 includes a hingedly mounted gate panel 118 connected to the gatepost 500A with a plurality of hinges 119. The hinges 119 support the gate panel 118 for pivoting movement about a hinge axis 119A (FIG. 20).

Figure 18:
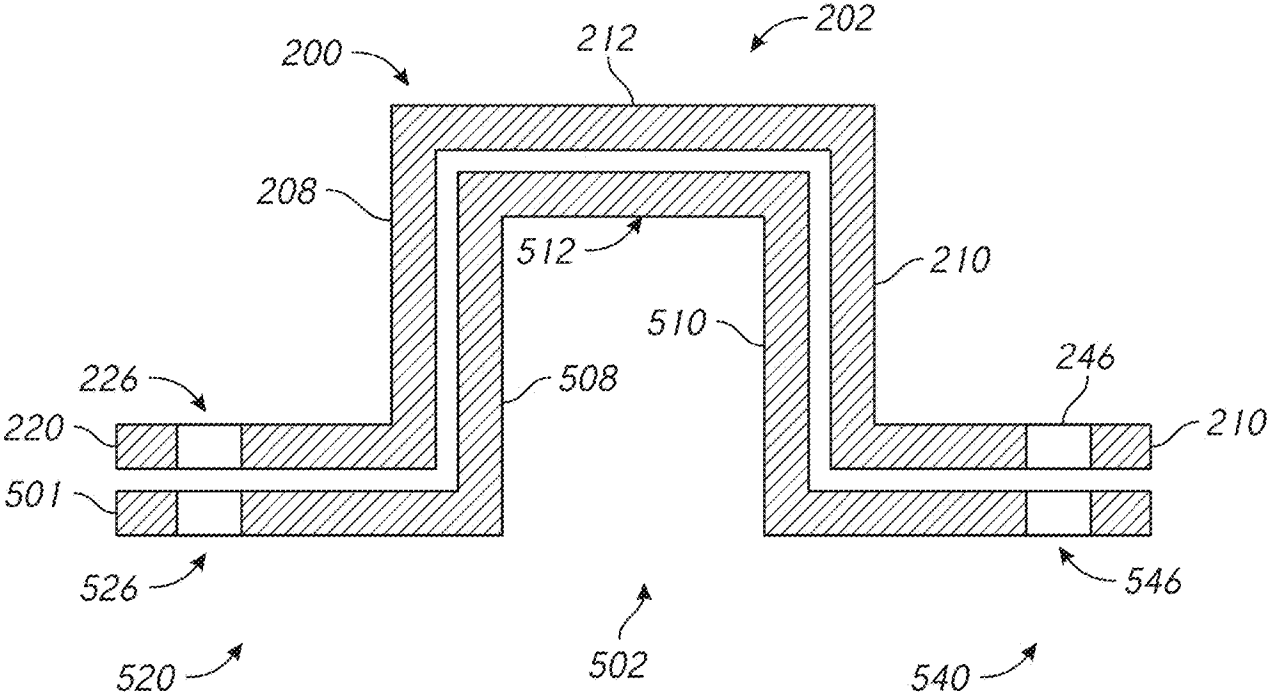
FIG. 18 is a schematic top plan view of the gatepost of FIG. 17.
Figure 17:
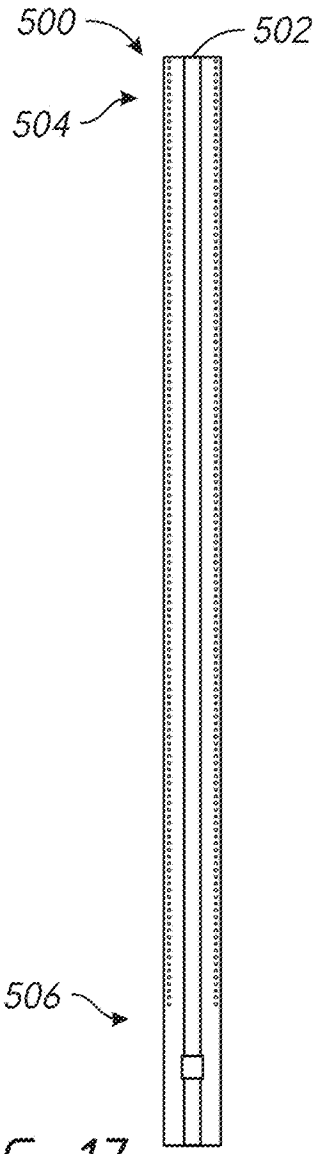
FIG. 17 is a front elevational view of a gatepost included in the gate assembly of FIGS. 15 and 16.

With reference to FIGS. 17 and 18, the gatepost 500, like the gatepost 200, can include an elongated fencepost member 502 and flanges 520 and 540. Optionally, the gatepost 500 can be formed with a fencepost member 200 and a secondary layer 501. Thus, the gatepost 500 can present an opportunity for savings in reducing the number of unique components for creating the fencing system 100.

With continued reference to FIG. 18, the secondary layer 501 can include parts forming the same or a complimentary cross-sectional shape with that of the fencepost 200. For example, the elongated fencepost portion 502 can include the first sidewall 508, second sidewall 510, and a center wall 512. The center wall 512 can connect the sidewalls 508, 510. Together, the sidewalls 508, 510 and center wall 512 form an elongated, generally U-shaped channel member portion 502. Additionally, this cross-sectional shape is complementary to the cross-sectional shape defined by the walls 208, 210, and 212. Thus, as shown in FIG. 18, the generally U-shaped configuration of the walls 508, 510, 512 can nest with the walls 208, 210, 212.

The secondary layer 501 also includes flange portions 520, 540, which can have generally the same orientation as the flanges 220, 240, respectively. Further, the secondary layer 501 can include pluralities of apertures 526, 546 which can also include alternating patterns of straight and countersunk holes. Further, the openings 526, 546 can be concentrically aligned with the plurality of openings 226, 246. Thus, the plurality of openings 526 and the plurality of openings 226, can define a plurality of axially aligned openings which can be used for fastening rails and/or other components to the gate post 500. The plurality of openings 546, 246 can also be aligned as such.

Optionally, the fencepost 200 and secondary layer 501 can be attached to each other by fasteners extending through openings 226, 526, 246, 546, by welding, adhesive, or other attachment techniques.

Figure 19:
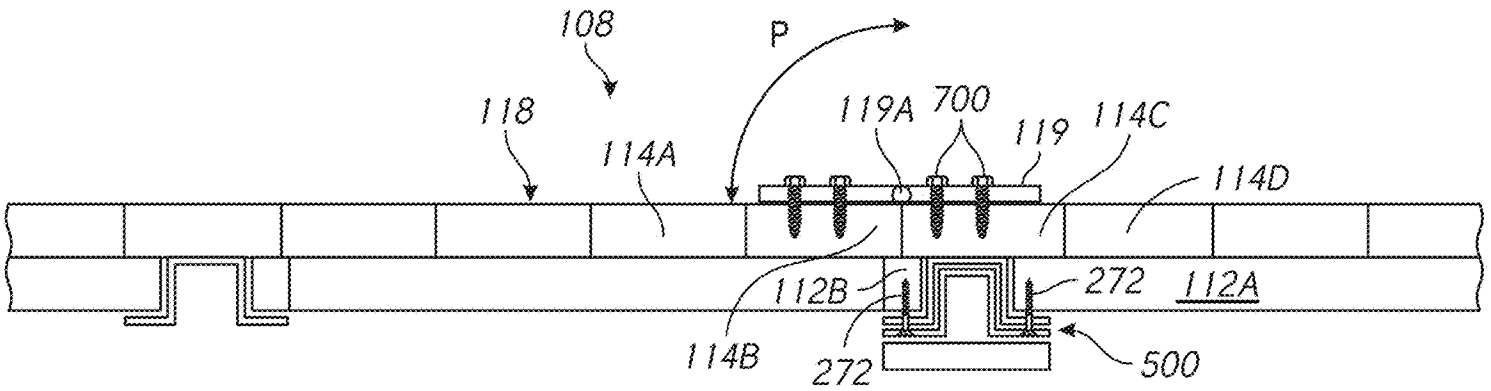
FIG. 19 is a schematic top plan view of the gate assembly of FIGS. 15 and 16 illustrating an optional mounting location of the gatepost of FIG. 17.

With reference to FIGS. 19 and 20, the gatepost 500 can be used to support one or both sides of a gate assembly 108. For example, as shown in FIGS. 19 and 20, the gatepost 500 can be attached to fence rail 112A and fence rail portion 112B with fasteners, for example 272. A fence board 114C can be attached to the rail 112A and rail portion 112B with fasteners (not shown). The hinge 119 can further be attached to the fence board 114C with additional fasteners 700. As such, structurally, the fixed portion of the hinge 119 is supported by the gatepost 500. The swivel portion of the hinge 119 can be attached to fence board 114B which is part of the pivotal fence panel 118 and which pivots around the hinge axis 119A along the direction of arrow P.

Figure 21:
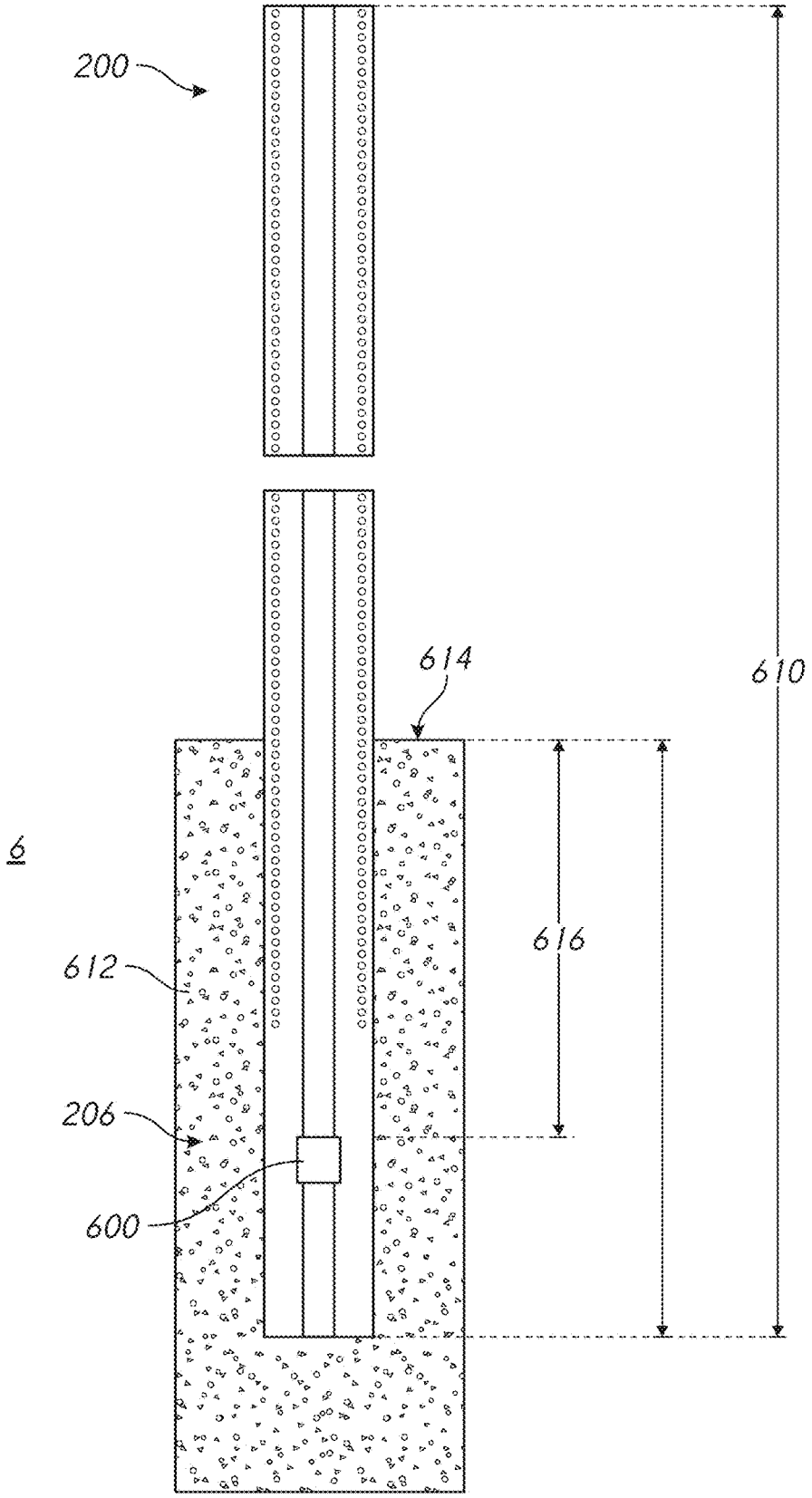
FIG. 21 is a front elevational and partial cutaway view of an embodiment of a fencepost having a concrete lock.
Figure 22:
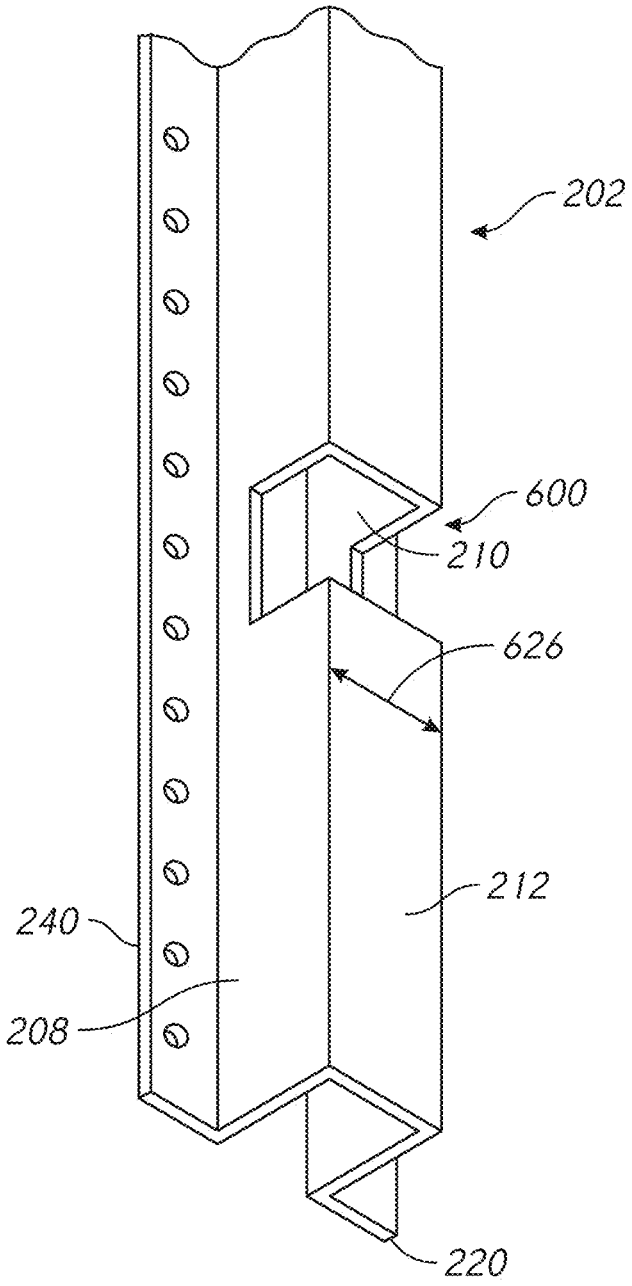
FIG. 22 is an enlarged perspective view of the concrete lock of the fencepost of FIG. 21.
Figure 23:
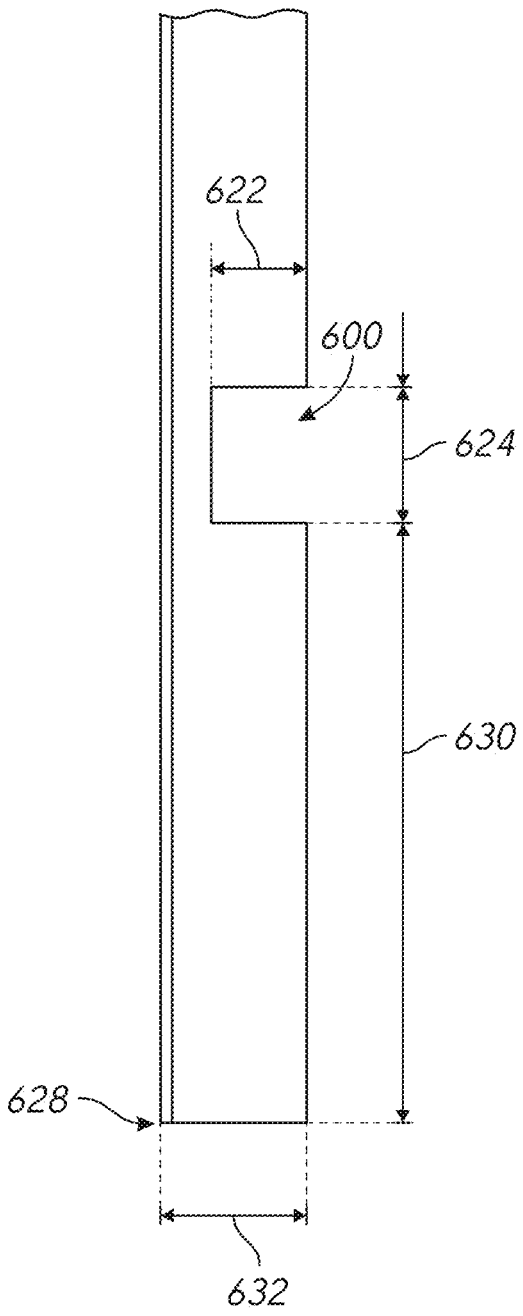
FIG. 23 is an enlarged side elevational view of the concrete lock of FIG. 22.

With reference to FIGS. 21-23, the cement lock 600 can be provided on any of the posts 200, 300, 400, 500. The illustrated embodiment of the cement lock 600 in FIGS. 21-23 is illustrated as being formed on the fencepost 200. However, the disclosure of the various embodiments of the cement lock 600 illustrated in FIGS. 21-27 are intended to apply to all of the posts 300, 400, and 500 as well.

With reference to FIG. 21, the fencepost 200 can have an overall length of 610. For example, in some embodiments, the overall length 610 can be from about 6 to about 10 feet. Some embodiments can be 8 feet long. Other lengths can also be used.

The fencepost 200 is designed for and intended to be inserted into the ground G. In some embodiments, the fencepost 200 can be fixed to a concrete footing 612. The concrete footing 612 can be prepared and constructed in accordance with techniques well-known in the art.

In accordance with some embodiments, the fencepost 200 is inserted into the concrete footing 612 sufficiently such that the concrete lock 600 is spaced from the upper surface 614 of the concrete footing 612 by a depth 616 of at least 12 inches. In some embodiments the depth 616 can be approximately one and one-third feet or approximately 16 inches.

An aspect of at least one of the inventions disclosed herein includes the realization that while a concrete lock aperture such as the concrete lock 600 can provide for enhanced flow of concrete therethrough when the concrete footing 612 is still flowable, prior to full curing, the concrete lock 600 does compromise the strength of the fencepost 200 with regard to wind and uplift loads imparted onto fencepost 200. For example, the removal of the material from the lower end 206 of the fencepost 200 reduces the strength of the lower end 206 of the fencepost 200 in bending and tensile loading. However, an aspect of at least one of the inventions disclosed herein includes the realization that by inserting the fencepost 200 such that the concrete lock 600 is spaced from the upper surface 614 by a spacing 616 of at least about 12 inches, the concrete lock aperture, and the associated reduction in strength of the lower end 206 of the fencepost 200 is spaced sufficiently away from the upper surface 614 so as not to compromise the strength and stiffness of the fencepost in the vicinity of the upper surface 614. However, the concrete lock 600, at such a depth, retains the ability to provide the additional securing function by accommodating a high volume and cross sectional area of flow through the concrete lock and thus provide enhanced and robust securement of the fencepost 200 to the concrete footing 612.

For example, in some embodiments, with reference to the FIGS. 22 and 23, the opening defining the concrete lock can incorporate portions of the sidewalls 208, 210 and the center wall 212 of the elongated fencepost member 202. This can provide an additional benefit in providing additional loading of all three walls 208, 210, 212 of the elongate fencepost 202 by way of allowing significant flow of concrete through the lock 600 during the installation process thereby resulting in a large cross-sectional portion of concrete hardening within the concrete lock 600. This enhances the ability of the concrete to provide reactionary load against edges of the concrete lock 600 that extend into the sidewalls 208, 210, and center wall 212. For example, an upward force on the fenceposts 200 which may be generated by wind or other loads, will be resisted by tensile loads applied to the walls 208, 210, 212 by hardened concrete extending through the concrete lock 600. Further, although the concrete lock 600 extends through the entirety of the width of the wall 212 and portions of the walls 208 and 210, the concrete lock 600 is sufficiently below the upper surface 614 so as to not affect the bending strength of the fencepost 200 in the vicinity of the upper surface 614.

Another aspect of at least one of the inventions disclosed herein includes the realization that concrete typically used for footings 612 for fence posts can include significant amounts of granular materials, such as stones, which can have one or more dimensions of about 1½ inches or more, some such granular materials can have non-uniform and non-round shapes. The inclusion of granular materials of such dimensions can negatively impact the flowability of the concrete when the concrete is poured during construction of a footing 612. Thus, when used for a fence post footing, the larger granular materials can impede flow of the associated concrete through a concrete lock aperture 600, 600A, 600B. In accordance with some embodiments, the height 624, 624A, 624B of the concrete lock can be at least 2.5 inches and in some embodiments, at least about three-inches and a width 622, 622A, 622B of at least about one-inch. With such a configuration, the concrete lock 600, 600A, 600B, better allows larger pieces of granular material included in the concrete during construction of a footing 612, to flow through the concrete lock 600, 600A, 600B and prevent the blockage of the concrete lock 600, 600A, 600B and thereby prevent the formation of large voids around the concrete lock 600, 600A, 600B and better anchor the associated fence post in the footing 612.

Thus, in some embodiments, the concrete lock 600 can have a depth 622 of about one-inch, a height 624 of about two-inches and in some embodiments about three-inches and a width 626 of approximately two-inches. Other dimensions can also be used. In some embodiments, the concrete lock 600 can be spaced from the lower edge 628 of the fencepost 200 by a spacing 630 which can be in some embodiments, approximately six inches.

Figure 24:
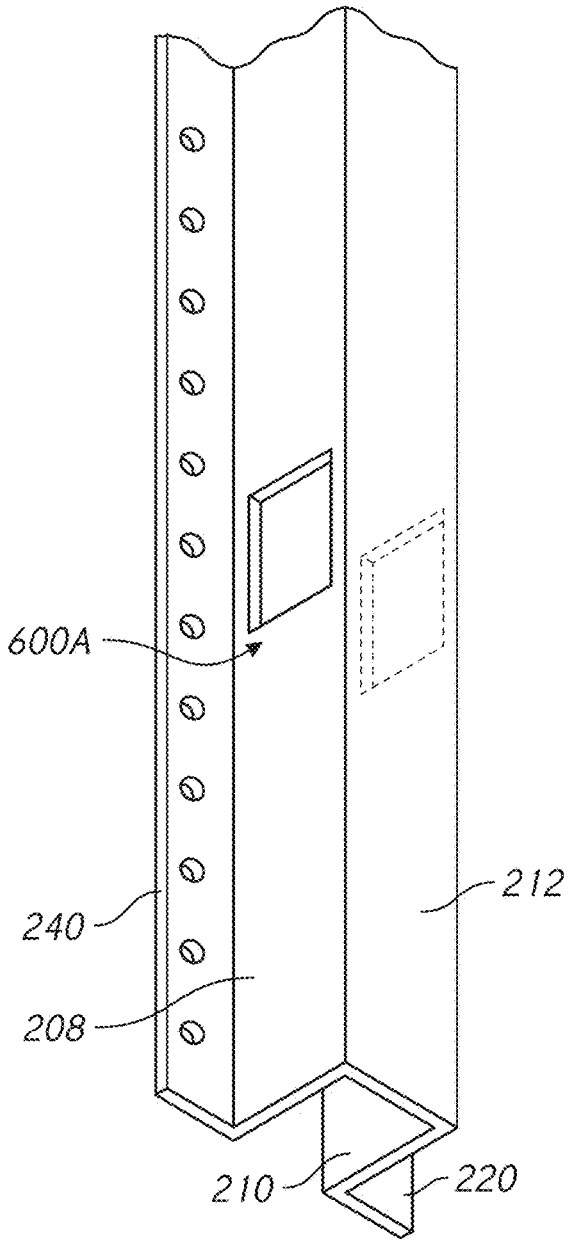
FIG. 24 is a perspective view of a modification of the concrete lock illustrated in FIGS. 21-23.

FIG. 24 illustrates a modification of the concrete lock 600, identified generally by the reference numeral 600A. Parts, components, and features of the concrete lock 600A which are similar or the same as corresponding parts, components, or features of the concrete lock 600 are identified with the same reference numerals, except that a letter "A" have been added thereto.

Figure 25:
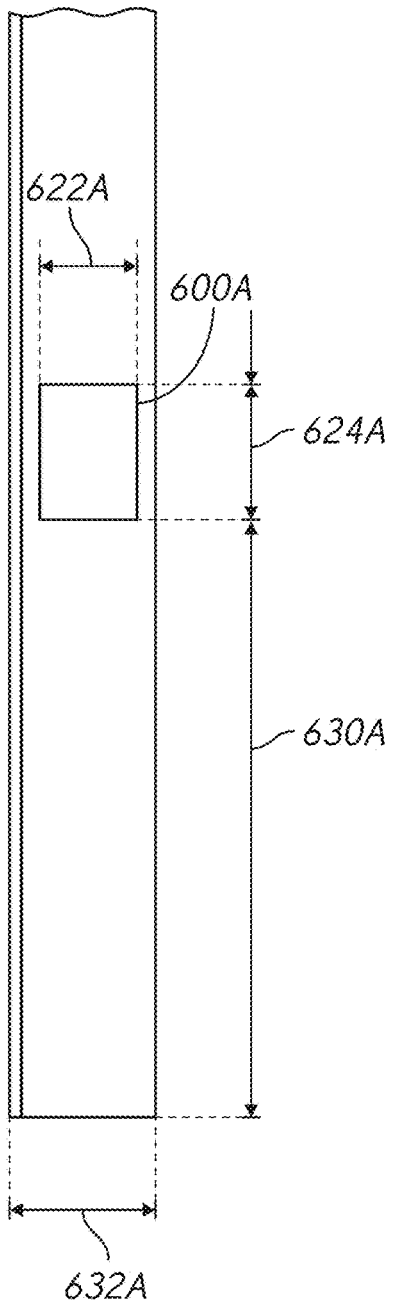
FIG. 25 is an enlarged side elevational view of the concrete lock illustrated in FIG. 24.
Figure 26:
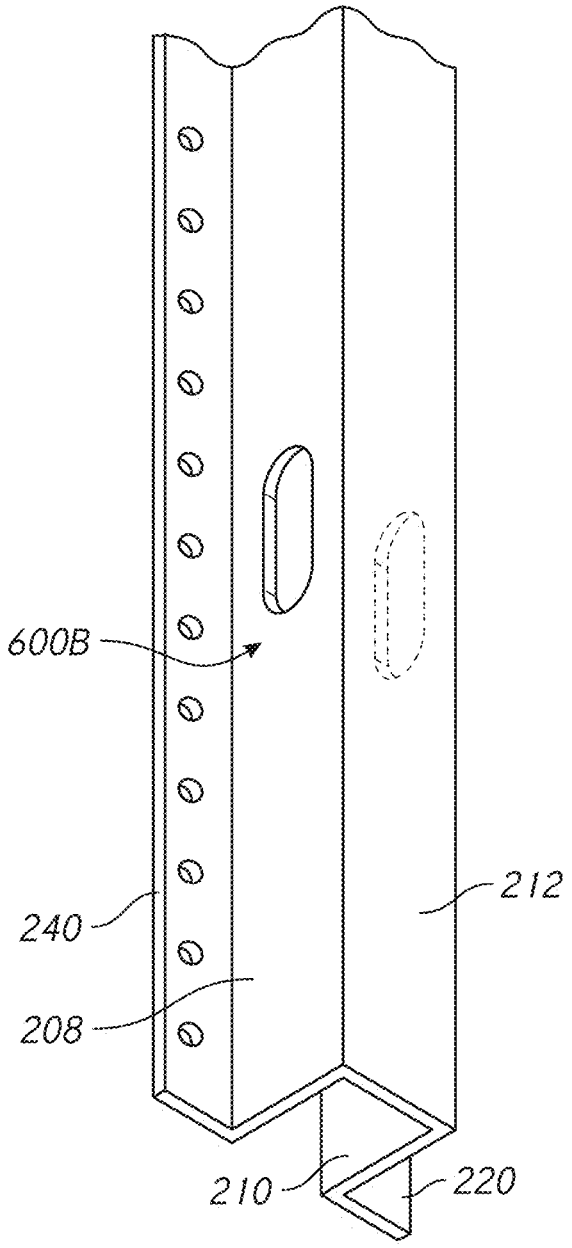
FIG. 26 is a perspective view of yet another modification of the concrete lock illustrated in FIGS. 21-23.

With reference to FIGS. 24 and 25, the concrete lock 600A is defined by concrete lock openings extending through both sidewalls 208, 210, but not the center wall 212. Rather, the concrete lock 600A is defined by a pair of aligned apertures extending through both sidewalls 208, 210. With reference to FIG. 26, the dimensions 622A, 624A, 630A and 632A can be about one-inch, three-inches, six-inches, and 1½-inches, respectively.

Figure 27:
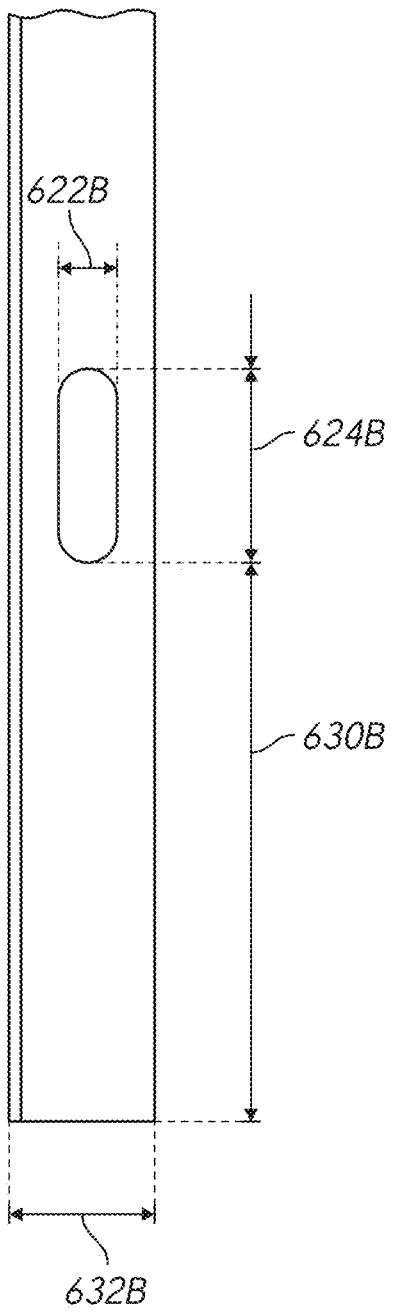
FIG. 27 is a side elevational view of the concrete lock illustrated in FIG. 26.

FIGS. 26 and 27 illustrate yet another modification of the concrete lock 600, identified generally by the reference numeral 600B. Parts, components, and features of the concrete lock 600B which are similar or the same as corresponding parts, components, or features of the concrete lock 600 or 600A are identified with the same reference numerals, except that a letter "B" have been added thereto, or the letter "A" has been replaced with the letter "B".

With continued reference to FIGS. 26 and 27, the concrete lock 600B is generally oval in shape. Similarly to that of concrete lock 600A, the concrete lock 600B is formed by a pair of aligned apertures and side walls 208, 210, but does not extend through the center wall 212.

This arrangement of concrete lock apertures can provide the additional optional benefit of providing a capture of a large cross-sectional piece of hardened concrete, following the installation of the fencepost 202 to a concrete footing 612, while preserving the tensile and bending strength of the center wall 212. Further, the apertures forming the concrete locks 600A and 600B, being disposed between the center wall 212 and the flanges 220, 240 can thereby provide a more balanced loading of the fencepost 200 by way of the interaction of hardened concrete with the concrete lock 600A, 600B.

With continued reference to FIG. 27, the dimensions 622B, 624B, 630B, and 632B can be about one-inch, three-inches, six-inches, and 1½-inches, respectively. Other dimensions can also be used.

FIG. 28-35 illustrate a modification of the gate post 500, identified generally by the reference numeral 800. Parts, components, and features of the gate post 800 that correspond to parts, components, and features of the gate post 500 have been identified with the same reference numeral, except that "300" has been added thereto.

With reference to FIGS. 28-31, the gate post 800 can include an elongated fence post member 802 and at least one flange 820. The gate post 800 can also include a first side wall 808, second side wall 810, and a center wall 812. The center wall 812 can connect to the side walls 808, 810. Together, the side walls 808, 810, and the center wall 812 form an elongated, generally U-shaped cross-section of the elongated fence post member 802. In this context, the center wall 812 can be considered as forming the "bite" of the U-shaped channel.

The flange 820 can extend outwardly from the U-shaped channel, defined by the side walls 808, 810, and the center wall 812. In the illustrated embodiment, the side walls 808, 810 are generally parallel to one another and both the side walls 808, 810 are generally perpendicular to the center wall 812. The free ends of the sidewalls 808, 810 can define an aperture leading into the space directly between the sidewalls 808, 810.

Optionally, the fence post member 802 can also include a first end wall 814 extending from the side wall 808 and a second end wall 816 extending from the side wall 810. The end walls 814, 816 can extend from the open end of the U-shaped channel. Optionally, the end wall 814, 816 can extend generally perpendicular to the side walls 808, 810, respectively, and generally parallel to the center wall 812. Additionally, the end wall 814, 816 can extend inwardly. As such, the end walls 814, 816 define an aperture 818 of the elongated gate post member 802. In the illustrated embodiment, the flange 820 extends from the end wall 816. As viewed in FIG. 29, the side walls 808, 810, central wall 812, end wall 816 and the flange 820 define a generally question mark-shaped cross section (when rotated 90° clock-wise).

The flange 820 can have the same features as the flanges 220, 240, described above. The flange 820 can include a plurality of apertures 846 which can be straight bore apertures, countersunk apertures or an alternating pattern of straight and countersunk apertures. In some embodiments, the apertures have a spacing 828 that can be one inch on center, or other spacings. In some embodiments, the plurality of apertures 846 is spaced from the top end or bottom end of the elongated fence post member 802 by a spacing of 830. In some embodiments, the spacing 830 is three-quarters of an inch. Other spacing can also be used. In some embodiments, the flange 820 can include two columns of apertures 846 each column having a pattern of alternating straight and counter sunk apertures. The alternating patterns can be offset from each other. For example, with reference to FIG. 30, the flange 820 includes a left side column of apertures 846 and a right side column of apertures 846. Each column includes an alternating pattern of straight apertures and countersunk apertures. Additionally, in a top row, the left side column includes a straight bore aperture and the right side column includes a countersunk aperture. As such, the alternating patterns of apertures are offset from each other. Other arrangements can also be used.

With continued reference to FIG. 29, the gate post member 802 can have a width 832 and a depth 834. In some embodiments, the gate post member 802 is generally square, dimensionally. Thus, in some embodiments, the width and depth 832, 834 can be about the same, and in some embodiments, about three inches. In some embodiments, the flange 820 can have a length 838, which can be about 1¼". Other lengths can also be used.

The overall depth of the gate post 800 can be defined as the depth 834 and a length 838 combined, forming an overall depth of 840. In some embodiments, the overall depth 840 can be 4¼". Other depths can also be used.

The end walls 814, 816 can have lengths 842, 844, respectively. In some embodiments, the length 842, 844 can be about ¾". Other lengths can also be used. The elongated gate post member 802 can be made from any material. In some embodiments, the elongated gate post member 802 is made from galvanized and stamped or rolled sheet steel having a thickness 847. In some embodiments, the thickness 847 is about 1/10".

The width of the aperture 818 is determined by the overall width 832 minus the lengths 842, 844, and the thickness 847. Thus, in some embodiments, the aperture 818 can be approximately 1.4".

In some embodiments, the apertures 846 can be spaced from the free edge of the flange 820 by a spacing 850. The spacing 850, in some embodiments, can be ⅜". Other spacings can also be used.

In some embodiments, the aperture 818 can be larger. For example, in some embodiments, the aperture 818 can be larger than 1.4 inches for example, 1.75 inches, or any size therebetween or other sizes. In the embodiments in which the aperture 818 is approximately 1¾ inches, the overall width 832 can be made larger, the end walls 814, 816 can be shorter, or other configurations can be used. In some embodiments, the end wall length 844 can be approximately ⅝ of an inch and the end wall length 842 can be about a half-inch, for example, 0.525 inches, and using other dimensions noted above, the aperture 818 can be 1.75 inches. An aperture 818 of 1.75 inches can be more accommodating of 2×4 fence rails that are larger than typical standard 2×4 s; occasionally a standard 2×4 can be up to 1.75 inches thick; still less than a "full dimension" 2×4.

With reference to FIG. 28, the gate post 800 can have an overall length 852 that can be the same as any of the other posts 200, 300, 400, 500, or other lengths.

Figure 32:
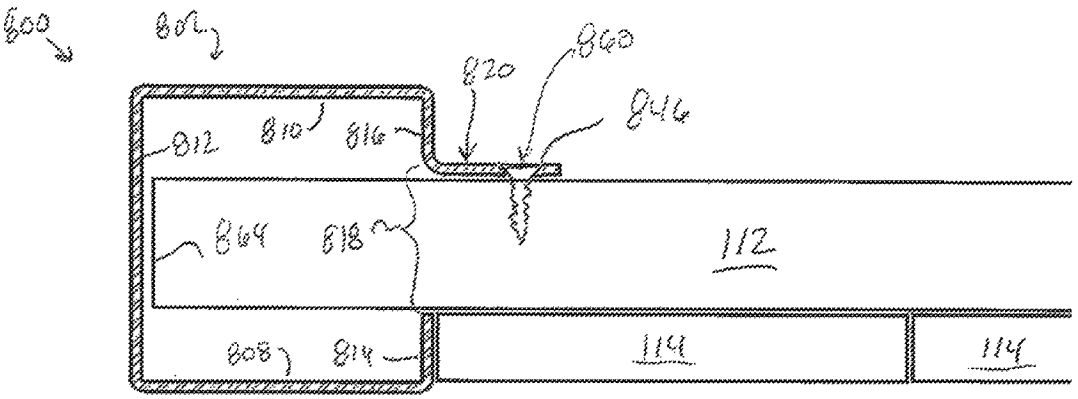
FIG. 32 is a schematic top plan view illustrating connection of the gate post of FIG. 28 with a fence rail and fence boards attached to the fence rail.
Figure 33:
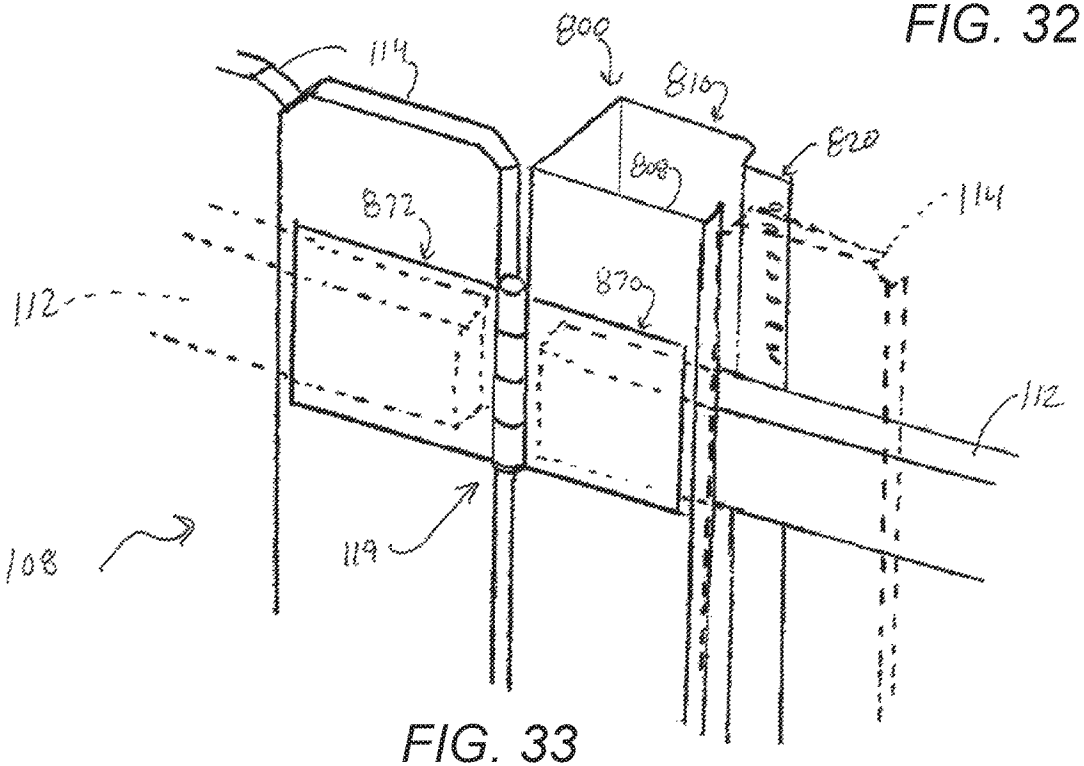
FIG. 33 is a top, back, and left-side elevational view of the fence post of FIG. 28, in use, connected to a fence rail on the left side and a hinge on the back surface connected to a gate.

With reference to FIGS. 32 and 33, the gate post 800 can be configured to be secured to fence rails, for example, fence rails 112. As shown in FIG. 32, the fence rail 112 can be in the form of a typical fence rail. In some embodiments, the fence rail 112 can be a standard 2×4. As well known in the art, a standard 2×4 is normally cut to approximately 1½"× 3½". As noted above, the aperture 818 can be approximately 1.4-1.5" wide. Thus, a standard 2×4 such as the fence rail 112 can be slightly thicker than the width of the aperture such that a standard 2×4 can be pinched in the aperture, thereby forming a tight fit with the aperture 818. This can provide a snug fit between the aperture 818 and the fence rail 112. In some environments of use, the rail 112 does not need to be inserted through the aperture 818, but can remain on the outside of the aperture 818.

The plurality of apertures 846 can be used in conjunction with fasteners 860 for securing the fence rail to the flange 820. As noted above, the fence rail 112 can be inserted through the aperture 818 so as to extend into the interior of the gate post 800. This can provide for a more secure connection between the fence rail 112 and the gate post 800. In some embodiments, the terminal end 864 of the fence rail 112 can be pushed up against the center wall 812 of the gate post 800. Such a configuration can provide further rigidity in the connection between the fence rail 112 and the gate post 800. Fence boards 114 can be attached to the fence rail 112, thereby providing a uniform appearance on a side of the fence. In some embodiments, the gate post 800 can be painted any desired color.

With reference to FIG. 33, in some optional modes of use, the hinge 119 can include a first hinge plate 870 and a second hinge plate 872. The hinge plate 870 can be secured to one of the side walls 808, 810 of the gate post 800. The other hinge plate 872 can be connected to a gate section 108.

Figure 34:
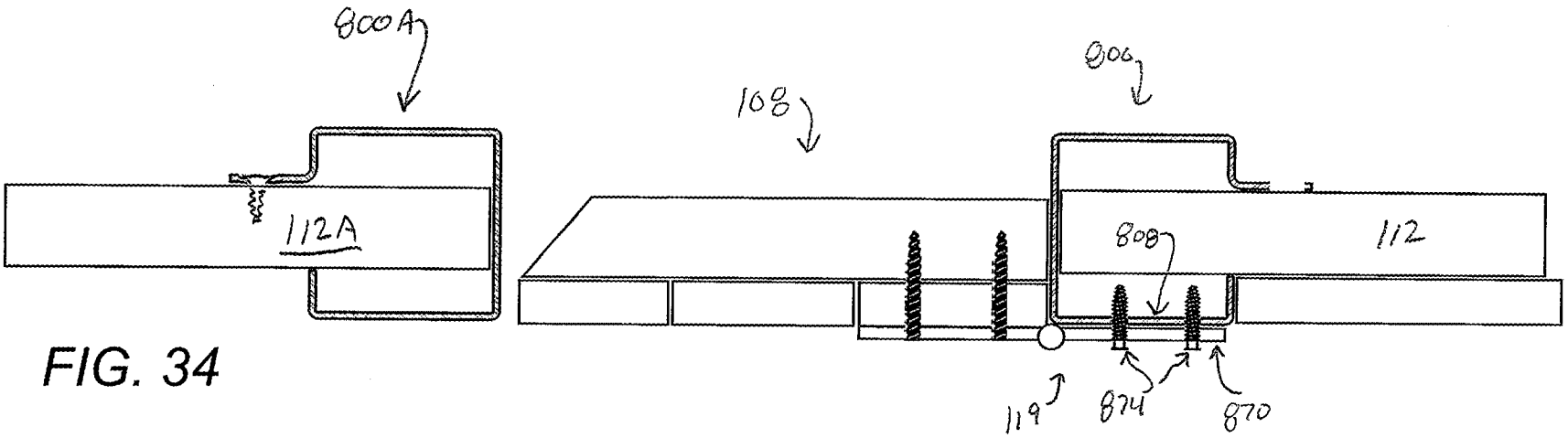
FIG. 34 is a schematic top plan view of a gate assembly incorporating two of the gate posts of FIG. 28 and forming a gate of a fence, with the gate in the closed position in FIG. 34.
Figure 35:
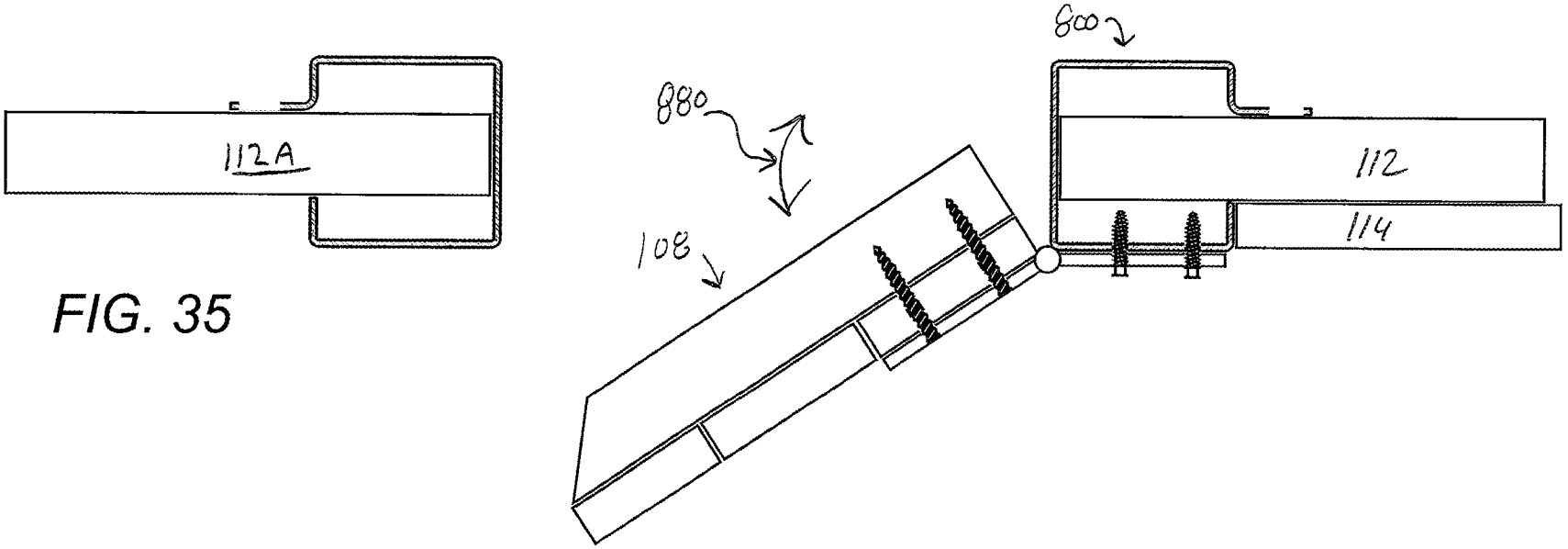
FIG. 35 is a schematic top plan view of the gate assembly of FIG. 34, with the gate in the open position.

For example, with reference to FIGS. 34 and 35, the hinge 119 can be used to connect a gate post 800 to a gate section 108. In the illustrated embodiment, the hinge plate 870 is attached to the side wall 808 of the gate post 800 with threaded fasteners 874. In some modes of use, an installer might predrill holes in the side wall 808 for receiving the fasteners 874.

The gate post 800 could also be used for securing an end of the fence adjacent the other end of the gate section 108. For example, as shown in FIGS. 34 and 35, a gate post 800*a* is used for forming an end of a section of fence adjacent the gate portion 108. A gate latch (not shown) can be attached to the gate post 800*a* and configured to engage a cooperating gate member (not shown) that can be mounted on the gate section 108, in a known manner. The gate latch and cooperating gate latch member can exert forces on the gate post 800*a* member when the gate section 108 is closed, and more significantly, if the gate section 108 is "slammed" shut; something that can happen many times during the lifespan of a fence. Using the gate post 800*a* can thus provide a means for reinforcing the portion of the fence ending at the gate post 800*a*, so as to better endure the forces often exerted onto the end of a fence adjacent a gate, such as closing and slamming noted above.

An aspect of at least one of the inventions herein includes the realization that the configuration of the gate post 800 allows it to be installed on either side of a gate section 108, simply by flipping it over. Thus, as illustrated in FIGS. 34 and 35, the gate post 800*a* can have the same configuration as the gate post 800 and be attached to another fence rail 112*a*. As such, the gate post 800*a* can provide a more secure rigid mount for the free end of the fence ending adjacent to the gate section 108, as well as providing a secure location for mounting the gate latch open (not shown). Configured as such, the gate section 108 can be swung between the position illustrated in FIG. 34 and the position illustrated in FIG. 35, by pivoting in the direction of arrow 880.

Although the present inventions have been described in terms of certain embodiments, other embodiments apparent to those of ordinary skill in the art also are within the scope of the present inventions disclosed herein. Thus, various changes and modifications may be made without departing from the spirit and scope of the inventions. For instance, various components may be repositioned as desired. Moreover, not all of the features, aspects and advantages are necessarily required to practice any one of the present inventions.

What is claimed is:

1. A steel and wood fence assembly, comprising:

a gate post including an elongated generally U-shaped channel member having a first side wall, a second side wall extending parallel to the first side wall and being spaced from the first sidewall by a channel width, and a center wall extending perpendicular to the first and second side walls and connecting the first and second side walls, the first and second side walls and the center wall forming a U-shaped channel, the elongate generally U-shaped channel member having a lower end and an upper end, the lower end configured to be inserted into the ground;

a first end wall extending inwardly from the first side wall, toward the second side wall, the first end wall having a first inner edge disposed inwardly from the first sidewall;

a second end wall extending inwardly from the second side wall, toward the first side wall, the second end wall having a second inner edge disposed inwardly from the second sidewall, the first and second inner edges defining an aperture of the U-shaped channel that is narrower than the channel width, the aperture being about 1½ inches wide;

a first flange having a first inner edge connected to the first side wall by the first end wall and having a first outer edge, the first flange extending parallel to the first side wall and perpendicular to the center wall;

the first flange comprising a first plurality of openings arranged longitudinally along the first flange, disposed between the first inner edge and the first outer edge, the first plurality of openings comprising an alternating pattern of straight openings and countersunk openings, wherein the plurality of openings are spaced sufficiently close such that at least two straight holes and at least two countersunk holes are disposed within a 4-inch span of the first flange along the longitudinal direction, wherein the first end wall and the first flange extend longitudinally along the U-shaped channel member so as to define a generally question mark-shaped cross section;

at least one of a gate latch and a gate hinge attached to the generally U-shaped channel member; and a first standard two-by-four wood fence rail extending through the aperture so as to extend into the interior of the U-shaped channel and attached to the first flange in a first position with two fasteners extending through either two of the straight openings or two of the countersunk holes in the first flange.

2. The fence assembly of claim 1, wherein the straight openings of the first and second pluralities of openings on both the first and second flanges have constant diameter bore configurations, and wherein the plurality of countersunk openings of the first and second pluralities of openings in both the first and second flanges have conical bore configurations.

3. The fence assembly of claim 1, wherein the aperture is narrower than the width of the first standard two-by-four wood fence rail and the first standard two-by-four wood fence rail is pinched in the aperture.

4. The fence assembly of claim 1, wherein the first end wall extends inwardly about ¾ of one inch from the first end wall.

5. A steel gate post for an in-line wooden fence, comprising:

an elongated generally U-shaped channel member having a first side wall, a second side wall extending parallel to the first side wall and being spaced from the first side wall by a channel width, and a center wall extending perpendicular to the first and second side walls and connecting the first and second side walls, the first and second side walls and the center wall forming a U-shaped channel, the elongate generally U-shaped channel member having a lower end and an upper end, the lower end configured to be inserted into the ground;

a first end wall extending inwardly from the first side wall, toward the second side wall, the first end wall having a first inner edge disposed inwardly from the first sidewall;

a first flange having a first inner edge connected to the first side wall by the first end wall and having a first outer edge, the first flange extending parallel to the first side wall and perpendicular to the center wall;

wherein the first flange comprises a first plurality of openings arranged longitudinally along the first flange, disposed between the first inner edge and the first outer edge, the first plurality of openings comprising an alternating pattern of straight openings and countersunk openings, wherein the plurality of openings are spaced sufficiently close such that at least two straight holes and at least two countersunk holes are disposed within a 4-inch span of the first flange along the longitudinal direction.

6. The fence gate post of claim 5, wherein the straight openings of the first pluralities of openings on the first flange have constant diameter bore configurations, and wherein the plurality of countersunk openings of the first pluralities of openings in the first flange have conical bore configurations.

7. The gate post of claim 5, wherein the first end wall extends inwardly about ¾ of one inch from the first end wall.

8. The gate post of claim 5 additionally comprising a second end wall extending inwardly from the second side wall, toward the first side wall, the second end wall having a second inner edge disposed inwardly from the second sidewall, the first and second inner edges defining an aperture of the U-shaped channel that is narrower than the channel width, wherein the aperture is about 1½ inches wide.

9. The gate post of claim 8, wherein the aperture and the U-shaped channel is configured such that a standard two-by-four wood fence rail can be inserted through the aperture and into the interior of the U-shaped channel and attached to the first flange.

10. The gate post of claim 9, wherein the aperture is narrower than the width of the first standard two-by-four wood fence rail and the first standard two-by-four wood fence rail is pinched in the aperture.

11. The gate post of claim 5 additionally comprising at least one of a gate latch and a gate hinge attached to the generally U-shaped channel member.

12. A gate post, comprising:

an elongated generally U-shaped channel member having a first side wall, a second side wall extending parallel to the first side wall and being spaced from the first side wall by a channel width, and a center wall connecting the first and second side walls, the first and second side walls and the center wall forming a U-shaped channel, the elongate generally U-shaped channel member having a lower end and an upper end, the lower end configured to be inserted into the ground;

a first end wall extending inwardly from the first side wall, toward the second side wall, the first end wall having a first inner edge disposed inwardly from the first sidewall;

a first flange having a first inner edge connected to the first side wall by the first end wall and having a first outer edge, the first flange extending transverse to the first end wall wherein the first flange comprises a first plurality of openings arranged longitudinally along the first flange, disposed between the first inner edge and the first outer edge, the first plurality of openings comprising an alternating pattern of straight openings and countersunk openings, wherein the plurality of openings are spaced sufficiently close such that at least two straight holes and at least two countersunk holes are disposed within a 4-inch span of the first flange along the longitudinal direction.

13. The gate post of claim 12 additionally comprising a second end wall extending inwardly from the second side wall, toward the first side wall, the second end wall having a second inner edge disposed inwardly from the second sidewall, the first and second inner edges defining an aperture of the U-shaped channel that is narrower than the channel width, wherein the aperture is about 1½ inches wide.

14. The gate post of claim 13, wherein the aperture and the U-shaped channel is configured such that a standard two-by-four wood fence rail can be inserted through the aperture and into the interior of the U-shaped channel and attached to the first flange.

15. The gate post of claim 12 additionally comprising at least one of a gate latch and a gate hinge attached to the generally U-shaped channel member.

16. The gate post of claim 12 wherein the center wall extends perpendicular to the first and second side walls.

* * * * *